United States Patent [19]

Speer

[11] Patent Number: 5,032,057

[45] **Date of Patent: * Jul. 16, 1991**

[54] AUTOMATIC VARIABLE PITCH MARINE PROPELLER

[75] Inventor: Stephen R. Speer, Spokane, Wash.

[73] Assignee: Nautical Development, Inc., Spokane, Wash.

[ * ] Notice: The portion of the term of this patent subsequent to May 29, 2007 has been disclaimed.

[21] Appl. No.: 376,112

[22] Filed: Jul. 6, 1989

Related U.S. Application Data

[63] Continuation-in-part of Ser. No. 216,014, Jul. 7, 1988, Pat. No. 4,929,153.

[51] Int. Cl.[5] ..... B63H 3/00; B63H 1/00

[52] U.S. Cl. ..... 416/43; 416/46; 416/53

[58] Field of Search ..... 416/46, 43, 157 R, 93 A, 416/53, 51, 52

[56] References Cited

U.S. PATENT DOCUMENTS

| | | | |
|---|---|---|---|
| 1,867,715 | 7/1932 | Seidel | 416/46 |
| 2,123,193 | 7/1938 | Lilley | 416/43 |
| 2,382,229 | 8/1945 | Humphreys | 416/43 |
| 2,694,459 | 11/1954 | Biermann | 416/46 |
| 3,231,023 | 1/1966 | Marshall | 416/43 |
| 4,419,050 | 12/1983 | Williams | 416/157 R |
| 4,802,872 | 2/1989 | Stanton | 416/93 A |

FOREIGN PATENT DOCUMENTS

| | | | |
|---|---|---|---|
| 537140 | 6/1941 | United Kingdom | 416/157 |

*Primary Examiner*—Edward K. Look
*Assistant Examiner*—Hoang Nguyen
*Attorney, Agent, or Firm*—Barry G. Magidoff

[57] ABSTRACT

There is provided a self-actuating, variable pitch propeller having a plurality of blades. All of the blades are automatically movable between a first, relatively lower pitch position and a second, relatively higher pitch position, substantially simultaneously and equally in response to achieving a predetermined combination of propeller rotational speed and hydrodynamic loading on the propeller blades. The blades are releasably locked to prevent pivoting of the blades, at least in the lower pitch position, but preferably can be locked in both the high and low pitch positions. More preferably, a feedback force is transmitted from the blade to the locking mechanism to vary the locking force in response to the net turning moment on the blade. The locking mechanism are released in response to the combined effects of centrifugal force generated by the blades and other portions of the propeller and the hydrodynamic loading on the blades.

21 Claims, 36 Drawing Sheets

FIG. 11
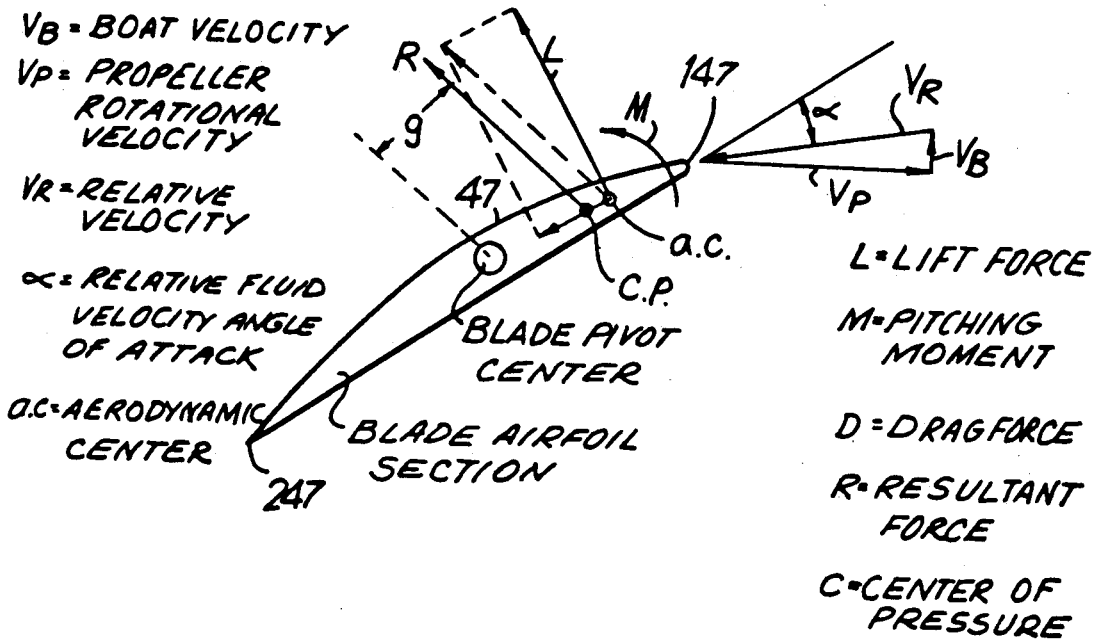
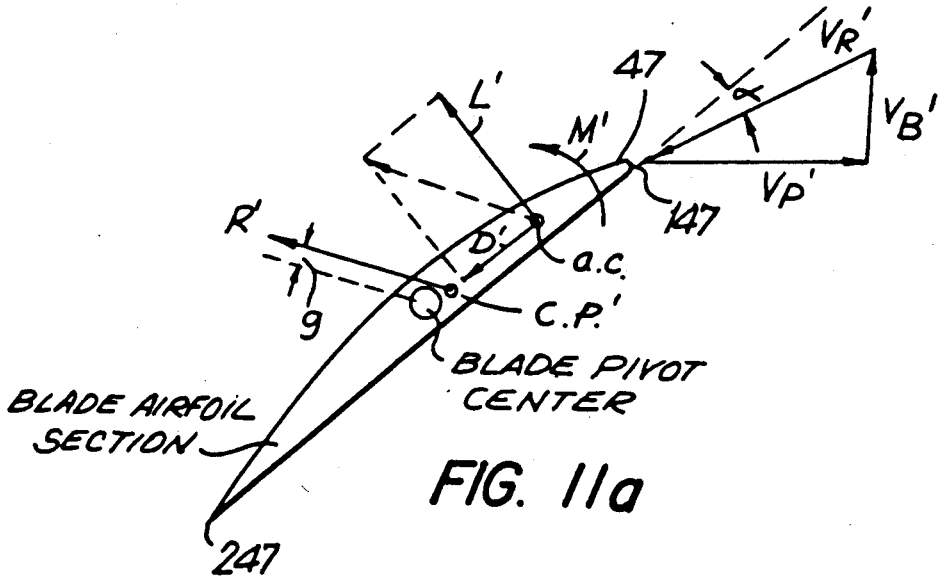
FIG. 11a $$M_B = \frac{w}{g} t\omega^2 \cos\beta \sin\beta 2 \int_{z-0}^{z-b/2} \int_{R-R_1}^{R-R_0} x^2 dx dR$$

COUNTERWEIGHT ORIENTATION TO PROVIDE INERTIAL BIAS TOWARD HIGH PITCH POSITION (VIEW LOOKING RADIALLY INWARD)

AUTOMATIC VARIABLE PITCH MARINE PROPELLER

This is a continuation-in-part of application Ser. No. 216,014, filed July 7, 1988 now U.S. Pat. No. 4,929,153.

This invention relates to self-actuating variable pitch marine propellers wherein the blade pitch is automatically variable between two discrete pitch positions.

BACKGROUND OF THE INVENTION

For marine propellers, propeller blade pitch is often defined in terms of "inches", i.e., defining the distance that a boat would be propelled through the water by a single revolution of the propeller, assuming no slippage, e.g., a propeller having a pitch of "13 inches", is one having the blade angle necessary to linearly advance the boat 13 inches upon one complete revolution of the propeller.

It has similarly been well understood that the conditions under which the boat will operate are important in determining the optimum pitch for the propeller, for an engine producing a certain maximum power output. Such operating conditions include the load, intended speed, and the type of hull, of the boat being propelled. For example, when a boat was to be used for towing a water-skier, i.e., a relatively heavy load, a propeller having a lower pitch would be selected, e.g., approximately a 15" pitch for a relatively small, 16 feet long outdoor pleasure boat with a 100 h.p. engine. Similarly, a higher speed boat with, e.g. a 300 h.p. engine, would use a relatively high pitch blade, e.g. a 21-inch pitch propeller.

Past workers have designed propellers which have manually resettable blade pitch positions. The pitch was set before starting the engine, and the pitch remained constant during continued engine operation. Such a device is shown for example in U.S. Letters Pat. No. 3,790,304. Other past designs have manually resettable blade positions that allow changes in the blade pitch position during operation. These have provided for manual adjustments made via mechanical, hydraulic or electric means. Such devices are shown for example in U.S. Letters Pat. No. 2,554,716; 3,216,507; and 4,599,043.

The prior art, recognizing the utility of propellers which vary blade pitch during operation of the engine, have devised various means of changing the pitch either in accordance with a self-actuating design, i.e. the pitch automatically changes based upon changes in operating conditions, e.g., engine RPM, or by operator-controlled means, such as pneumatic or hydraulic controllers. Self-actuating propellers, which are apparently continuously variable over a range of pitch positions, are suggested for marine propellers by Reid in U.S. Pat. No. 3,177,948, and for aircraft propellers by Lagrevol and Biermann, in U.S. Pat. Nos. 2,669,311 and 2,694,459. A propeller, especially adapted for an outboard engine for marine use, having both manual and automatic self-actuating variable pitch means, is shown in U.S. Pat. No. 2,682,926, to Evans.

Other devices which provide for automatic, self-actuated changes in blade pitch positions, wherein the blades are spring biased against change, is shown for example in U.S. Pat. Nos. 2,290,666, 2,988,156; 3,145,780; 3,204,702; 3,229,772; 3,231,023; 3,295,610; and 3,567,336. In addition, there have been variable pitch marine propeller designs which are actuated by a sudden, or sharp, change in engine RPM to provide the necessary impetus to shift the blade pitch. Examples of such devices are shown in U.S. Pat. Nos. 3,275,083 and 3,302,725.

Prior self-actuating propellers intended primarily for uses on aircraft have incorporated means to lock the blades in one or more blade positions. Such devices are shown for example in U.S. Letters Pat. Nos. 2,669,311 and 2,694,459, and German Patent publication No. DE 3,429,297.

GENERAL OBJECTS

It is an object of the present invention to provide, especially for a marine propeller, dependable self actuating means for shifting between a first, lower pitch blade position, and a second, higher pitch blade position, with changes in such boat operating conditions as engine RPM and boat speed and/or boat acceleration. It is a further object of the invention to provide dependable, self-actuating pitch-changing means that will change in response to achieving a predetermined boat speed, which varies based upon the rate of acceleration. It is yet another object of this invention to provide means to automatically change marine propeller pitch at a sufficient engine speed range which is dependent upon the load on the engine and on the propeller blades.

A still further object of this invention is to provide a propeller blade pitch-shifting mechanism which will prevent blade flutter and/or propeller rpm hunting during boat operation regardless of changes in hydrodynamic load on the propeller. It is yet another object of this invention to affirmatively lock the propeller blade into a defined or discrete, pitch position until predetermined hydrodynamic conditions are achieved to remove the lock and so permit a change in the blade pitch. It is a further object of this invention to provide a variable pitch marine propeller which is self-contained and thus capable of being interchanged with a fixed pitch propeller without otherwise modifying the engine or drive train. It is yet another object of the present invention to provide a variable pitch marine propeller which will permit engine exhaust gases to pass internally through the propeller hub from the engine drive shaft

GENERAL DESCRIPTION OF THE INVENTION

In accordance with the present invention, there is provided a self-actuating, variable pitch propeller having a plurality of blades, wherein each blade is automatically movable between a first, relatively lower pitch position and a second, relatively higher pitch position and, wherein the blades are all movable substantially simultaneously and equally in response to achieving a predetermined combination of propeller rotational speed and of hydrodynamic loading on the propeller blades. The self-actuated, variable pitch marine propeller of the present invention comprises a hub designed to be rotatably secured to a power source; a plurality of blades pivotally secured to the hub, each blade being secured about a pivot axis; releasable pivot locking means to prevent the pivoting of each blade when in the locked position; pitch change means to cause the blades to pivot when the pivot locking means are released; and, preferably, coordinating means to assure substantially equal and simultaneous pivoting movement of all of the blades There is preferably also provided feedback force means acting in opposition to the release of the locking means with a force generally proportional to the hydrodynamic loading on the blades.

BRIEF DESCRIPTION OF THE DRAWINGS

A further understanding of the present invention can be obtained by reference to the preferred embodiments set forth in the illustrations of the accompanying drawings. Each drawing depicting the operating mechanism of the propeller of this invention is within itself drawn to scale, but different drawings are drawn to different scales. Referring to the drawings:

FIGS. 11 and 12 are generalized sketches describing the forces acting on the propeller blades;

FIG. 11*a* is a higher speed representation of the blade forces shown in FIG. 11;

DETAILED DESCRIPTION OF THE INVENTION

Figure 1:
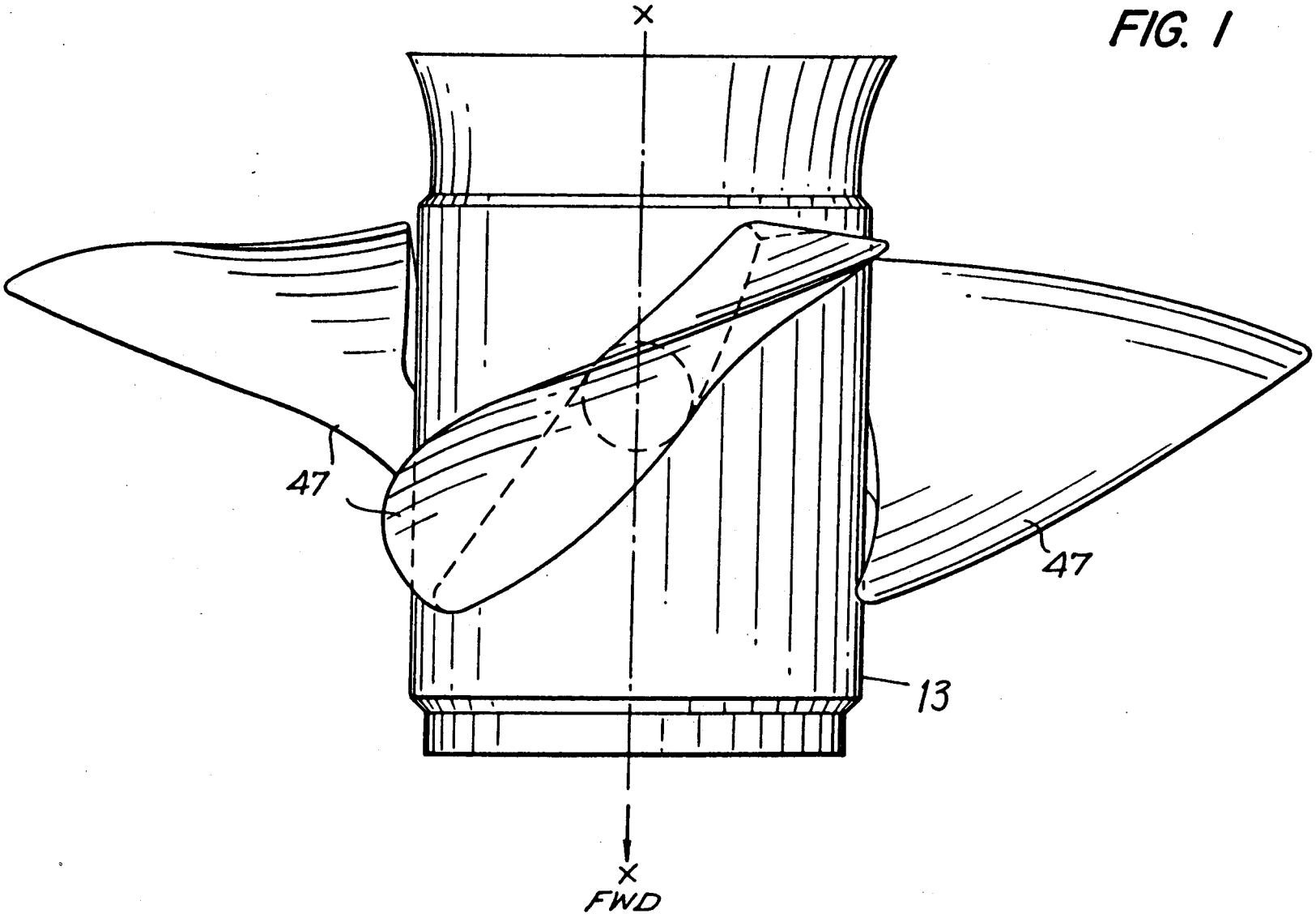
FIG. 1 is a side elevation view of a preferred embodiment of the variable pitch marine propeller of the present invention, having three equally spaced propeller blades.

The present invention utilizes the relationship between the hydrodynamic forces, lift ("L"), Drag ("D"), and Pitching Moment ("M"), and the inertial turning moments ($M_B$) acting upon the propeller blades, in a manner which was not previously recognized to be useful. The computations needed to define these forces have been generally well established by current engineering theories, but the interaction of all these factors had not previously been formulated in connection with the operation of an automatic, self-actuating variable pitch propeller. For the present invention, these computations are utilized to determine the dynamic load conditions acting on the propeller blades, with changes in boat velocity and acceleration and propeller (or engine) rotational speed (RPM), as the factors to be considered in the design of a self-actuating variable pitch propeller.

Referring to the drawings of the improved embodiments of the propeller of this invention, a hub case 13, 413 has three propeller blades 47, 447 rotatably journalled to it. This propeller is designed to be detachably secured, without any further change, to an outboard engine or stern drive system in place of a conventional fixed pitch propeller. The present invention can also be adapted to an inboard engine drive shaft.

Concentrically located within and fixed to the hub case 13, 413 is an inner hub and rigid web, generally indicated by the numerals 113, 513 and 201, respectively. Each blade 47, 447 is secured to a retainer shaft 40, or integrally formed with a blade shank 440, extending radially and being journalled through the outer hub case 13, 413 and to the inner hub 113, 513, and supported by two cylindrical bearing supports (44 and 45 or 444 and 445) on the outer case 13, 413 and inner hub 113, 513, respectively In designing a self-actuating, pitch-changing mechanism for a particular propeller blade configuration, certain physical principals of dynamic force relationships must be considered. The means for determining these dynamic forces are individually well known to the art and their computation is readily accomplished by following currently available engineering computation methods. However, the interrelationship of these forces has not previously been utilized in this context. Considering first the hydrodynamic forces acting upon the propeller blade surfaces, the marine propeller blade is a lifting body, or hydrofoil, acting similarly to an aircraft wing. The combined hydrodynamic forces created by the rotation of the propeller generates a thrust to propel the boat. The resultant hydrodynamic force acting on each blade changes significantly, both in magnitude and in location on the blade, depending upon the relative water velocity and angle of attack ("$\alpha$"), which are in turn related to the boat's forward velocity and propeller rotational speed.

Figure 27:
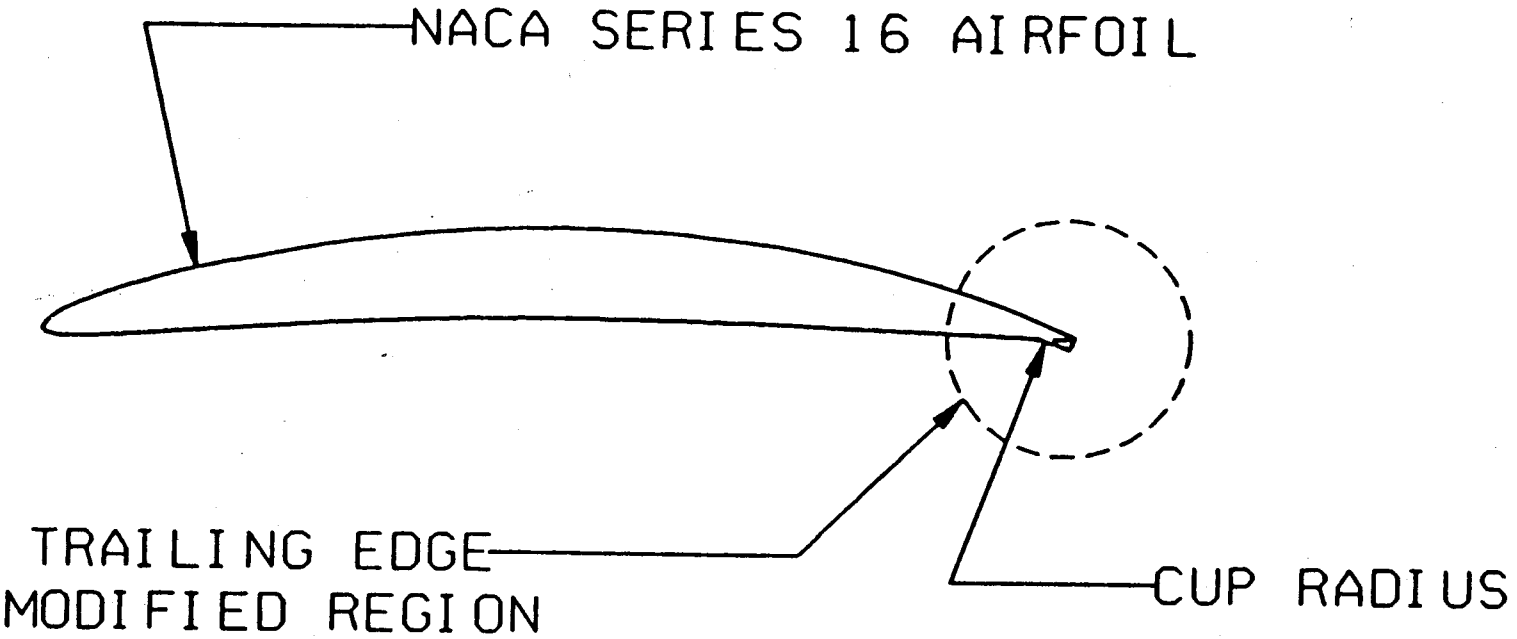
FIG. 27 is an outline of a typical NACA series 16 airfoil showing the "cupping" modification.

In conventional aerodynamic theory (*Theory of Flight*, by Richard Von Mises, Dover Publications, 1959, and *Foundation of Aerodynamics*, by A.M. Kuethe & J.D Schetyer, John Wiley & Sons, 1959), the algebraic summation of the pressures acting over the entire airfoil, or blade surface, can be represented as a single, resultant hydrodynamic force, having its point of application defined as the "center of pressure" ("c.p."). Conventionally, the "aerodynamic center" ("a.c."), of a blade, or airfoil, is defined as a point where the airfoil section pitching moment coefficient does not change but remains constant regardless of changes in the fluid angle of attack of the blade. For conventional airfoil sections, the aerodynamic center is generally between the 23 and 27 percent chord position and is commonly estimated to be at the 25 percent chord position Furthermore, for most conventional airfoil sections (e.g. NACA Series 16), the pitching moment coefficient is negative, i.e., tends to bias the airfoil toward a lower angle of attack (pitch). For this automatic, self-actuating variable pitch position marine propeller, the vector magnitude and direction of the resultant hydrodynamic force and the location of the center of pressure relative to the blade pivot axis are among the major parameters in determining the timing of the pitch change For propeller applications on high performance boats, it is generally desirable to use blades wherein the airfoils are modified at the trailing edge by forming a downward (or outward) edge curl, see FIG. 27. This trailing edge airfoil modification is commonly referred to as "cupping". This "cup" helps to prevent flow separation, or propeller "blow out", when operating in a cavitating or ventilating situation.

A design consequence of utilizing "cupped" propeller blades in the variable pitch propeller described herein is that the cupping of the trailing edge effectively moves the airfoil center of pressure further towards the trailing edge.

Figure 12:
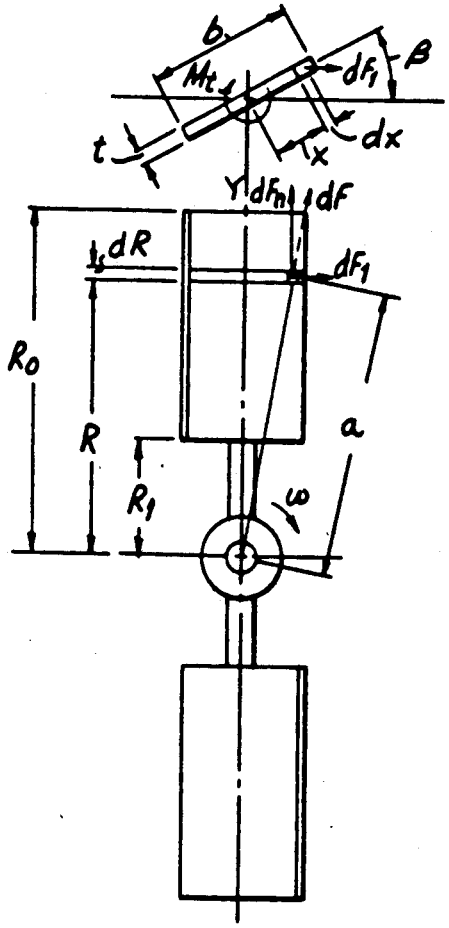

Referring to FIG. 12, which describes the instantaneous forces acting upon a propeller blade as the boat is initially accelerated from a relatively low boat velocity ($V_B$), the resultant hydrodynamic force ("R") acting upon the propeller blade 43, 447 is a function of the lift force ("L"), the drag force ("D") and pitching moment ("M"). The center of pressure for such low boat velocity with high propeller rotational velocity is located relatively close to the blade's leading edge 147, e.g., at approximately the 20% mean aerodynamic chord ("MAC"). As the boat's velocity ($V_B'$) through the water increases, however, the drag force increases (to D'), the pitching moment increases to (M'), and the lift force decreases (to L'), such that the resultant hydrodynamic force (R') is reduced. Equally significant, the center of pressure moves aft (to C.P.') towards the trailing edge 247 of the blade, e.g., the center of pressure can move to about the 60% MAC location, under high velocity, low angle of attack conditions. (see FIG. 11) Generally when the boat linear speed and propeller rotational speed are at their respective maximum operating levels, the center of pressure will lie between the 35% to 55% MAC range for conventional NACA linear 16 airfoils, and between the 45% to 60% MAC range for the cupped airfoils. Thus, whereas the preferred blade pivot center for "non-cup" blades was previously described to be between the 35% to 55% mean aerodynamic chord, the optimum blade pivot center for "cupped" blades is between the 45% to 60% mean aerodynamic chord.

The resultant hydrodynamic force ("R.) acting on each propeller blade 47 is the direct geometric sum of the torque force (Q) and thrust force (T) components, i.e., $$R = \sqrt{T^2 + Q^2}\,, \tag{1}$$

Very rough approximations of the torque force (Q) and the thrust force component (T) at a constant speed, can be obtained by the following formulae:

$$T = n375h/vN, \tag{2}$$

wherein h is engine horsepower, n is propeller efficiency, V is the boat velocity (mph) and N is the number of blades on the propeller; and $$Q = t/rN, \tag{3}$$

wherein t (torque) = 63000h/s; r is the radial distance from the propeller shaft centerline to the blade center of pressure, and s is the rotational speed of the propeller (RPM).

The above formulae can be rendered somewhat more precise by following the methods set forth in current engineering literature, for example, in T.P. O'Brian, "*THE DESIGN OF MARINE SCREW PROPELLERS*", (Hatchinson Scientific and Technical, 1969).

The resultant hydrodynamic turning moment ("$M_h$") acting on each blade at the pitch change condition can be calculated as follows $M_h = Rg$, wherein R is the absolute value of the hydrodynamic vector, R, as calculated above by Equation 1, multiplied by the perpendicular distance (g) between the vector R and the blade pivot center. The value of "g" is in turn determined by the location of the center of pressure (c.p'), and the direction of the vector R' at the conditions of pitch change. The location of c.p. can be determined for each blade design and operating parameters, in accordance with well-known aerodynamic or hydrodynamic methodology, as explained more fully in the above-cited texts.

Another force independently acting to change the pitch position of the blade is the propeller blade rotational, or inertial, force moment ($M_B$). In determining the magnitude of this inertial force, the blade can be approximated as a thin curved plate having its mass distributed within a plane intersecting the blade pivot center line, as shown in FIG. 12, for calculating out the moment "M", from the following equation:

$$M_B = W/g\,(tw^2\cos B\,\sin B)\,2\int_{x=0}^{x=b/2}\int_{R=R_1}^{R=R_o} x^2\,dx\,dR \qquad (4)$$

This inertial force tends to move the blade in a direction to reduce its pitch, and is proportional to the square of the rotational speed of the blade. Procedures for calculating inertial turning moments of propellers are described in current engineering literature, for example, in H. Mabine and F. Ocvik, "*MECHANISMS AND DYNAMICS OF MACHINERY*", (John Riley and Sons, Inc. 1963).

Experience has shown that the preferred low pitch position of the variable pitch propeller of the present invention, e.g., for pleasure boats with engines rated at from 100 to 300 horsepower, should be in the range of from about 12 ins. to about 16 ins., and the high pitch position for such craft should be in the range of from about 17 ins. to about 23 ins. The optimum settings of propeller pitch are a function of the design speed of the boat in combination with the engine speed, and the propeller:engine speed drive ratio. For high powered speed boats, having a high horsepower-to-weight ratio, such as boats that are capable of speeds in excess of 50 MPH, a high-pitch of as great as 28 ins., can be used. Between the extreme limits of high- and low-pitch positions, the angular rotation of each blade can be in the range of from about 4 to about 12 degrees, but preferably not greater than about 7 to about 9 degrees. This is generally sufficient to provide the desired flexibility and economy of operation, with a reasonable size and efficiency.

For minimizing the magnitude of the force needed to pivot the propeller blades between the low and the high pitch positions, the magnitude of the resultant hydrodynamic moment about the blade pivot center should be as low as possible, at the conditions of the pitch change. For this purpose, the blade pivot center should be located such that the center of pressure for the resultant hydrodynamic force, at the time the blades are to pivot, is as close to the pivot center as is feasible It has been found most effective to locate the pivot center for each blade along a line between the 35% and 55% mean aerodynamic chord, for conventional NACA airfoils, and between 45% and 60% mean aerodynamic chord for "cupped" airfoils. For both types of propeller, the location of the MAC is determined when viewing the blade geometry in a developed or planar representation, i.e., a view where all blade section chord lines are represented in a common plane by removing the blade section angular twist and rake components. Further, when dealing with conventional NACA 16 series airfoils, the blade pivot center is most preferably located between the 50% and 55% MAC; but between the 52% to 57% MAC for cupped NACA series 16 airfoils.

Typical cupped propeller blade geometry is shown by FIGS. 28–31; conventional blades are shown by FIGS. 8–11*a*. These designs, useful in the variable pitch propeller of the present invention, are typical of conventional design practice with the exception of modifications made to provide adequate structural strength and efficient fluid flow characteristics adjacent the location of the pivot center 10.

The blade 47, 447 is thus modified to accommodate the pivot center location near the root chord regions. The modification region extends outwardly from the root chord for approximately one-quarter of the blade span. The blade shank 440 diameter is preferably from about 17 to about 25% of the total blade span, i.e., distance from the hub outer surface to the blade tip, to provide sufficient structural strength. In order to minimize the fluid flow degradation in the modified, or thicker, root chord region, a higher thickness-to-chord ratio airfoil is provided from the outer portion of the modified region towards the root section. The design chord length at the root section is preferably in the range of from about 0.8 to about 1.3 times the length of the blade span. The actual root chord length is generally less than the design chord length to facilitate manufacturing.

Figure 10:
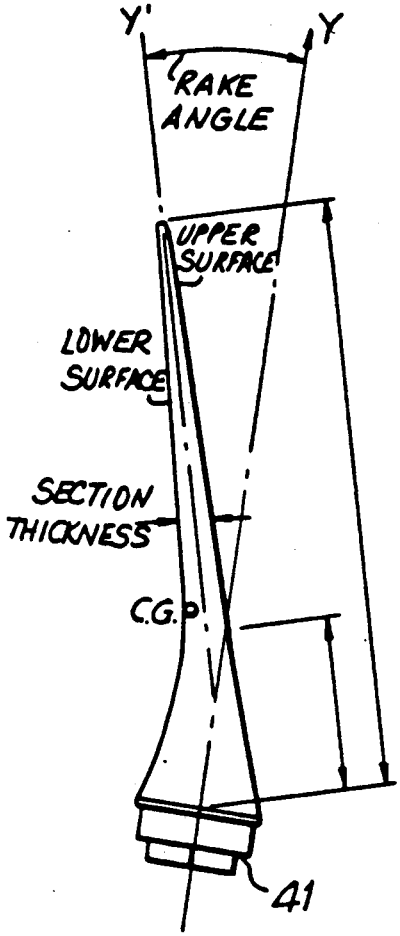
FIG. 10 is a cross-section view taken along lines 10—10 of FIG. 8.
Figure 31:
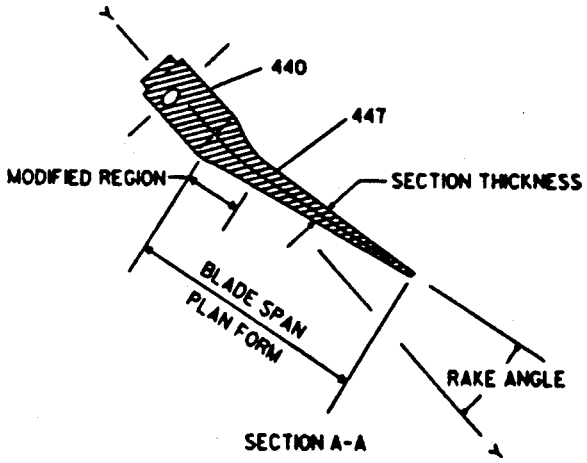
FIG. 31 is a cross-section view taken along lines 31—31 of FIG. 28.

The thickness of the blade airfoil section at the outer point of the modified region is typically from about 8% to about 10% of the chord length, and is then linearly tapered downwardly to a thickness of from about 2% to about 4% of the chord length at the blade tip. The root section airfoil should have a maximum thickness of from about 15% to about 22% of the root chord design length. Outward of the modified root chord region (as illustrated in FIGS. 10 and 31), the blade generally presents a constant rake angle of between 12 and 17 degrees. The following Table I, referring to FIG. 28–31, exemplifies cupped blade design geometry, in tabular form, for boats of from 1500 to 5000 lbs total weight, powered by engines having from 100 to 400 horsepower, with maximum propeller rotational speed of from about 1500 to about 4000 RPM. The pivot center location of the blade is positioned between the 50 to 55% MAC position, and substantially centered in the root section between the upper and lower airfoil contour lines.

TABLE I

BLADE DATA, "CUPPED" NACA 16 SERIES AIRFOILS

| y | Design Chord (In.) | Actual Chord (In.) | Twist Angle (Deg) | Maximum Thickness (In.) | Design Percent Maximum Thickness | Design Chamber |
|---|---|---|---|---|---|---|
| 0 | 5.6 | 5.0 | 0 | 1.00 | 18 | NACA 63 |
| .5 | 5.6 | 5.2 | 5 | .72 | 12.8 | 64 |
| 1.0 | 5.6 | 5.4 | 10 | .48 | 8.5 | 65 |
| 1.5 | 5.7 | 5.5 | 14 | .40 | 7.0 | 65 |

TABLE I-continued

BLADE DATA, "CUPPED" NACA 16 SERIES AIRFOILS

| y | Design Chord (In.) | Actual Chord (In.) | Twist Angle (Deg) | Maximum Thickness (In.) | Design Percent Maximum Thickness | Design Chamber |
|---|---|---|---|---|---|---|
| 2.0 | 5.8 | 5.6 | 17 | .34 | 5.8 | 65 |
| 2.5 | 5.8 | 5.6 | 20 | .29 | 5.0 | 65 |
| 3.0 | 5.6 | 5.4 | 23 | .24 | 4.3 | 65 |
| 3.5 | 5.0 | 4.8 | 25 | .19 | 3.8 | 65 |
| 4.0 | 3.8 | 3.6 | 27 | .13 | 3.4 | 65 |
| 4.5 | — | — | 29 | .07 | — | 65 |

RAKE ANGLE = 15. Deg. (For Y ¢ 1 in.)
BLADE SPAN = 4.5. ins.
BLADE AREA = 27 sq. ins.
BLADE MEAN AERODYNAMIC CHORD = 5.1 ins.
BLADE PIVOT CENTER = 3.1 ins. AFT OF ROOT CHORD LEADING EDGE
BLADE PIVOT CENTER = 2.8 ins. AFT OF MAC LEADING EDGE (55% MAC)
HUB RADIUS = 2.3 ins. (Y = O Station)

Figure 9:
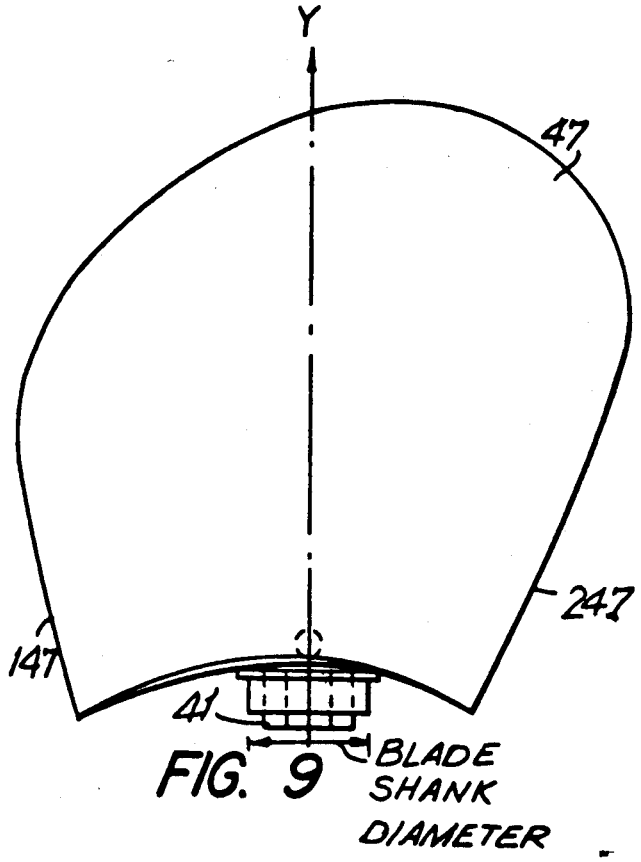
FIG. 9 is a plan view of the propeller blade of FIG. 8.
Figure 8:
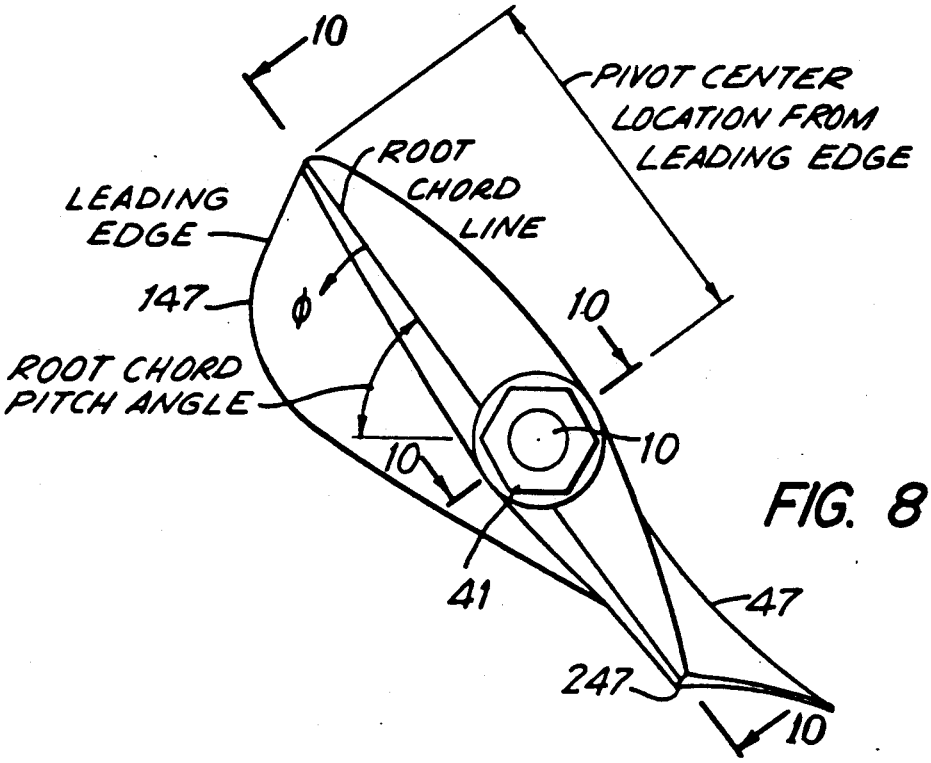
FIG. 8 is an end view of a single propeller blade.

The following Table II, referring to FIG. 8-10, exemplifies blade design geometry for conventional NACA 16 Series Airfoils, equivalent to Table I above, except that the blade is not cupped and the pivot center of the blade is positioned between the 45% to 50% MAC position.

TABLE II

BLADE DATA, NACA 16 SERIES AIRFOILS

| y | Design Chord (In.) | Actual Chord (In.) | Twist Angle (Deg) | Maximum Thickness (In.) | Design Percent Maximum Thickness | Design Chamber |
|---|---|---|---|---|---|---|
| 0 | 6.00 | 5.45 | 0 | 1.200 | 20 | NACA 63 |
| .5 | 6.25 | 5.58 | 5 | .875 | 14 | 64 |
| 1.0 | 6.25 | 5.71 | 10 | .562 | 9 | 65 |
| 1.5 | 6.00 | 5.85 | 14 | .480 | 8 | 65 |
| 2.0 | 6.00 | 5.96 | 17 | .425 | 7.08 | 65 |
| 2.5 | 6.00 | 6.00 | 20 | .370 | 6.16 | 65 |
| 2.75 | 6.00 | 6.00 | 21.5 | .343 | 5.72 | 65 |
| 3.0 | 6.00 | 6.00 | 23 | .315 | 5.25 | 65 |
| 3.5 | 6.00 | 5.75 | 25 | .260 | 4.33 | 65 |
| 4.0 | 5.50 | 5.25 | 27 | .205 | 3.73 | 65 |
| 4.5 | 4.50 | 3.75 | 29 | .150 | 3.33 | 65 |
| 4.75 | — | — | 30 | .080 | — | — |

RAKE ANGLE = 15. Deg. (For Y ¢ 1 in.)
BLADE SPAN = 5.0. ins.
BLADE AREA = 27 sq. ins.
BLADE MEAN AERODYNAMIC CHORD = 5.5 ins.
BLADE PIVOT CENTER = 3.1 ins. AFT OF ROOT CHORD LEADING EDGE
BLADE PIVOT CENTER = 2.6 ins. AFT OF MAC LEADING EDGE (47.3% MAC)
HUB RADIUS = 2.3 ins. (Y = O Station)

Turning to the embodiment of FIGS. 2-15, a hexagonal head end 41 secures each shaft 40 to the blade 47, and to a blade arm 3. The three blade arms 3, extend axially along the hub, adjacent the interior surface of the outer hub 13, so as to pivot together with its respective blade 47.

Slidably located within and concentric with the hub 13 is a coordinating ring 11, axially movable relative to the hub 13. The forward end **3*b* of the blade arm 3 is located radially inwardly of the coordinating ring 11 and is pivotally movable between two anchor pins 1, 2 which are secured to the inner wall of the coordinating ring 11**.

The locking mechanism, and lock release mechanism, for each blade is of the type generally known in kinematics as a four-bar linkage. In the illustrated embodiment, the locking assembly is a bell crank assembly generally indicated as 112 (shown in enlarged detail in FIG. 6), and comprises a central link, or bell crank 4, and two end links 5, 6. The inner ends of the two end links 5, 6 are pivotally connected to the ends of the bell crank 4 by two bell crank pins 7, 8. The outer ends of each of the end links 5, 6 are rotatably secured to the anchor pins 1, 2, respectively. A central bell crank pivot pin 9 pivotally connects the bell crank 4 to the forward end **3*b* of the blade arm 3**.

Figure 5:
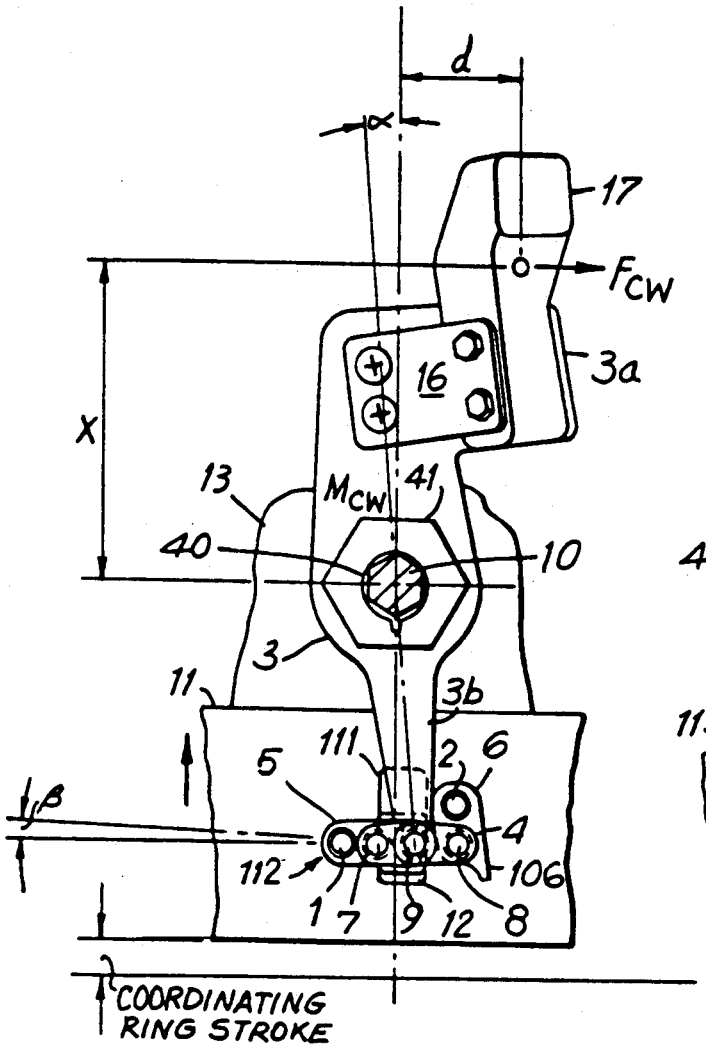
FIG. 5 is a partial cross-sectional view taken along lines 5—5 of FIG. 3.

The geometry of the bell crank linkage assembly 112 is such that in the loW pitch locked position shown in FIG. 5, an anchor pin 1, the bell crank pins 7, 8, and the central bell crank pin 9 are positioned substantially along a straight line. When in the high pitch locked position of FIGS. **5*a* and 6, the other anchor pin 2, and the bell crank pins 7, 8, 9 are positioned substantially along another straight line, one located rearwardly of the low pitch straight line. Thus, the axial distance between the two anchor pins 1, 2 i.e. from the front to the rear of the hub, must be not substantially greater than the distance between the two pins 1, 7 and 2, 8, respectively in each of the two end links 5, 6**.

Secured to the rearward end of the blade arm 3, which at its forward portion **3*b* is substantially a flat plate, is a curved arm 3*a* extending out of the plane of the forward portion of the blade arm 3*b*, radially inwardly of the hub and tangentially offset in the direction of rotation of the propeller from the flat portion of the blade arm 3*b*. Secured to the outer end of the curved arm 3*a*, is a relatively heavy counter-weight 17 having a mass approximating that of the blade, e.g. preferably, at least about 70% of the mass of the blade 47, further supported from the blade arm 3 by a brace 16. Alternatively, the blade arm 3 and counter-weight 17 can be formed as an integral unit, if desired. The counter-weight 17 is oriented in this manner, relative to the blade pivot axis 10, so that the centrifugal force acting on the counter-weight 17 creates a turning moment about the blade pivot axis 10, acting to rotate each blade 47** toward a higher angle of pitch.

A pitch change actuating and return mechanism, which serves to release the locked bell crank linkage mechanism 112 is provided by one or more slider mechanisms, generally indicated by the numeral 123, which serves to move the coordinating ring 11 with a change in engine, or propeller, rotational speed. An anchor block 20 is rigidly secured to the inner surface of the hub 13. A curved pivot link 22 is pinned at one end to the block 20 by pin 27; the second end of the pivot link 22 is also rotatably secured to an actuating weight 23 by another pin 28. One end of a straight link 24 is also pivotally pinned to the actuating weight 23 by the pin 28; the second end of that straight link 24, in turn, is pivotally connected by a pin 29 to a slider block 26. The slider block 26 is rigidly secured to the forward end of the coordinating ring 11. A second optional pair of links 21, 25, acting along lines parallel to the first pair of links 22, 24, respectively, can be pivotally secured between the actuating weight 23 and the anchor block 20 and the slider block 26, respectively, to provide additional support. The optional support links 21, 25 are so disposed that the curved optional link 21 moves parallel with the curved link 20, and the optional straight link 25 moves parallel with the straight link 24.

An actuator biasing spring 31 is pressed between a flange 32 on the inner surface of the hub 13, at its forward end, and to a button 30 secured to the coordinating ring 11, at its rearward end, such that the coordinating ring 11 is biased towards the rear of the hub 13. The geometry of the actuating weight links 21, 22, 24, 25 is such that the effective force exerted by the actuating weight 23 against the spring biased coordinating ring 11 increases as the weight moves radially outwardly towards the hub 13, i.e. the links 21, 22, 24, 25 provide an improved mechanical advantage as they rotate outwardly: the two rearmost curved links 21, 22 rotate clockwise and the two forward-most straight links 24, 25 rotate counterclockwise, as the weight 23 moves radially outwardly.

In the preferred embodiment shown in FIG. 5, the bell crank assembly 112 in the low pitch position is positioned slightly over-center, i.e., the axis of the bellcrank pin 7 is forward of a line drawn between the axes of the bell crank pivot pin 9 and the anchor pin 1. This over-centered position provides additional locking security against early release. Also, this overcenter position provides a control force feedback for altering the lock release timing depending upon the blade hydrodynamic loading. Under the high loads resulting from rapid boat acceleration conditions, the resultant hydrodynamic force is high and the center of pressure is positioned forward, near the aerodynamic center; this results in a high hydrodynamic turning moment about the blade pivot axis, acting to turn the blade toward higher pitch. This turning moment is countered by a force reaction at the blade arm pin 9 which is also the pivot center of the bellcrank locking mechanism.

When the locking mechanism is in the overcenter position, the force reaction acting on pin 9 arising from the hydrodynamic turning moment will tend to hold the locking mechanism in the overcenter or locked position. Thus, the greater the hydrodynamic turning moment, the greater the overcenter locking force. Since the lock release force biasing means is derived from centrifugal forces, a higher propeller rotational speed (rpm) will be required to overcome the higher hydrodynamic locking force component. This design arrangement provides the desirable effect of having the engine speed accelerate to a higher rpm before the shift in blade position from low to high pitch occurs during higher boat loading, or faster acceleration, conditions than during lower loading, or slower acceleration, conditions.

The effect of the hydrodynamic turning moment locking force feedback is determined by the magnitude of the overcenter angle beta, ($\beta$), as established by the link stops 105, 106; the first stop 105 governs the overcenter locked position when the blades are locked in low pitch, while stop 106 governs the overcenter position when the blades are locked in high pitch. It should be noted that the locking mechanism, when positioned in the low pitch position provides a locking force feedback for boat acceleration conditions. Conversely, the locking mechanism, when positioned in the high pitch position, provides a locking force feedback for boat deceleration conditions.

The stop stubs 105, 106, incorporated into the inner end of each of the end links 5, 6, respectively, are each less than one-half the height of its respective link 5, 6, and thus includes a contact surface 14*a* located beyond the center line of the link; each stub 105, 106 is intended to make contact with the bell crank pivot pin 9. The over-center angle, beta (B), is measured by the line drawn between an anchor pin 1, 2 and the pivot pin 9 and the line between an anchor pin 1, 2 and its respective link pin 7, 8; beta is preferably in the range of from about 0.5 to about 5 degrees, and most preferably from about 1.5 to about 2.5 degrees. Larger values for the overcenter angle are not needed for this embodiment because of the relatively small net forces acting on the locking means and the release means.

Figure 6:
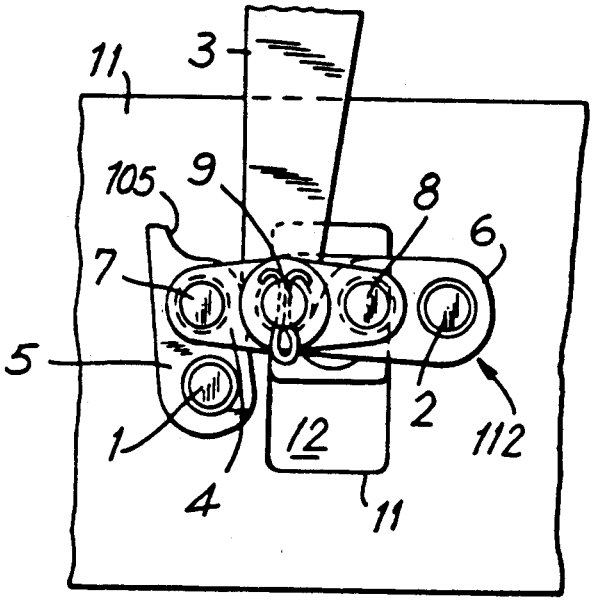
FIG. 6 is an enlarged detail view of a portion of FIG. 5*a*.
Figure 6A:
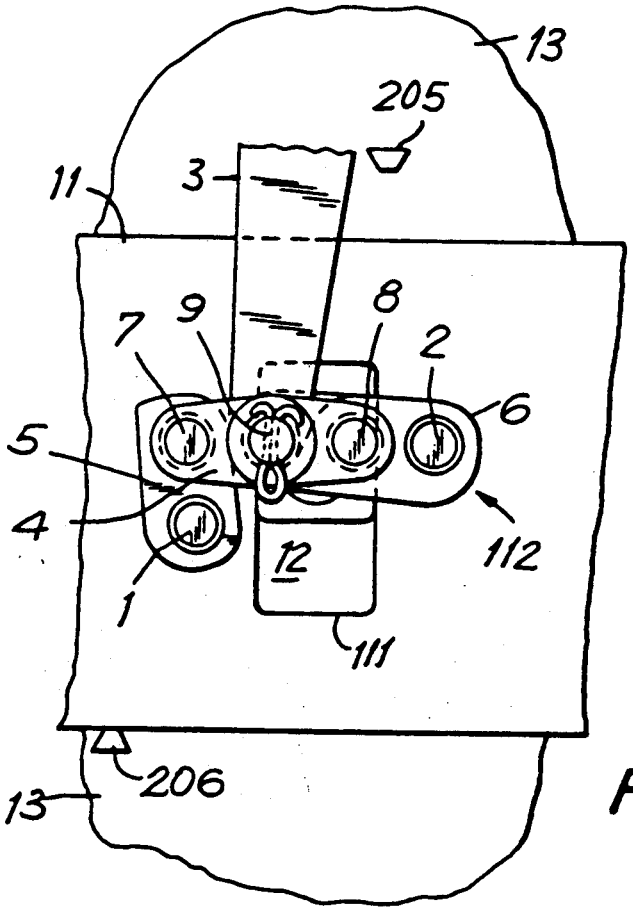
FIG. 6*a* is an enlarged detail view of FIG. 6 in the low pitch position.
Figure 7A:
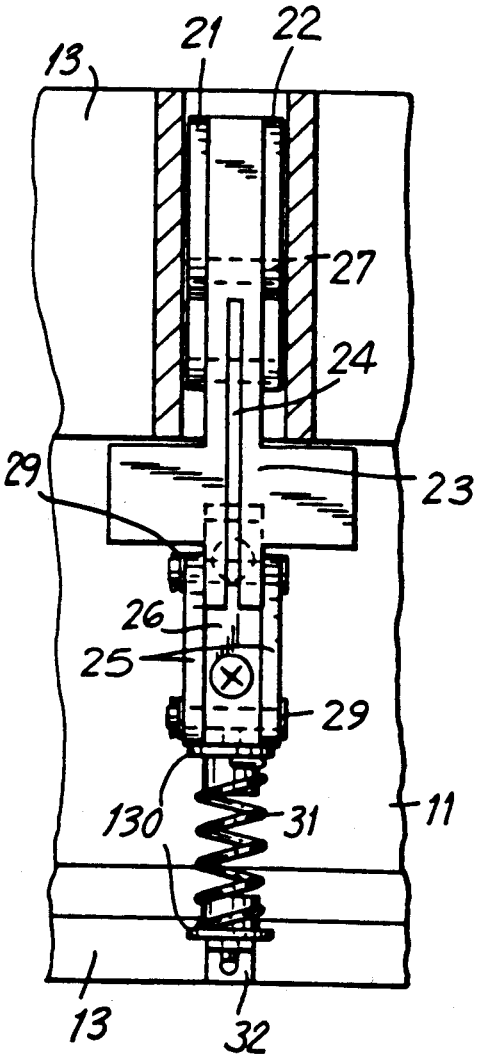
FIGS. 7 and 7*a* are cross-sectional views showing the actuating means in the high pitch and low pitch position, respectively, and taken along lines 7—7 of FIG. 3.
Figure 7:
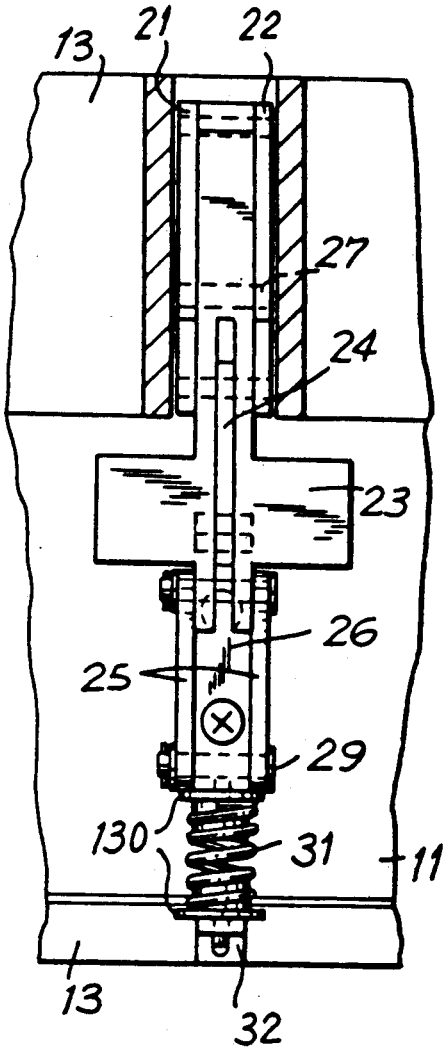

Alternative, a pair of stop ridges 205, 206, can be formed on the interior surface of the hub 13, as shown in FIG. 6*a*. Movement of the coordinating ring 11 towards the low pitch position, is limited by the upper stop ridge 205, and towards the high pitch position, by the lower ridge stop 206, such that the desired relationship between the link pins is attained for each position.

As the engine speed increases, and the rotational speed of the propeller assembly increases, centrifugal forces acting on the actuating weights 23 also increase, causing the weights 23 to shift radially outwardly towards the outer hub 13. The actuating weight 23 is biased towards the radially inward position shown in FIG. 4 by the spring force of spring 31 acting against the coordinating ring 11 which in turn acts through the support links 24, 25 on the actuating weight 23. As the centrifugal force exerted by the weight 23 increases, it acts against the biasing force of the spring 31, until the centrifugal force exceeds the spring 31 bias force, the locking mechanism 112 over-center force component, and friction; the weight 23 will then move radially outwardly, thereby causing pivoting of the connecting links 21, 22, 24 and 25, acting against the coordinating ring 11 to move it in a forward direction, against the pre-load force of the spring 31, to the high-pitch position. The high pitch position, for the actuating weights 23 and the coordinating ring 11, is shown in FIG. 4*a*.

The pitch change actuating mechanisms 123 are so designed as to increase its mechanical advantage as the actuating weight 23 swings radially outwardly, i.e., towards the hub case 13, thereby increasing the force acting on the coordinating ring 11, in opposition to the bias force of the spring 31. Thus, the force generated by the actuating weight 23 as it swings outwardly is greater than the spring rate of the spring 31, thereby insuring a continuous and smooth forward movement of the coordinating ring 11. Further insuring this smooth movement of the ring 11 is the reduction in the effect of friction, i.e., from static friction to sliding friction, and the release of the locking linkage 112. Also, the mechanical geometry of the actuating mechanism 123 is designed to provide that the rotational speed of the propeller must be reduced to a substantially lower rpm to cause the blades to return to the low pitch position, than is required to cause the mechanism to move to the high pitch position. This tends to reduce premature release of the locking mechanism when down shifting, and improves the smoothness of the pitch change movement.

Figure 4:
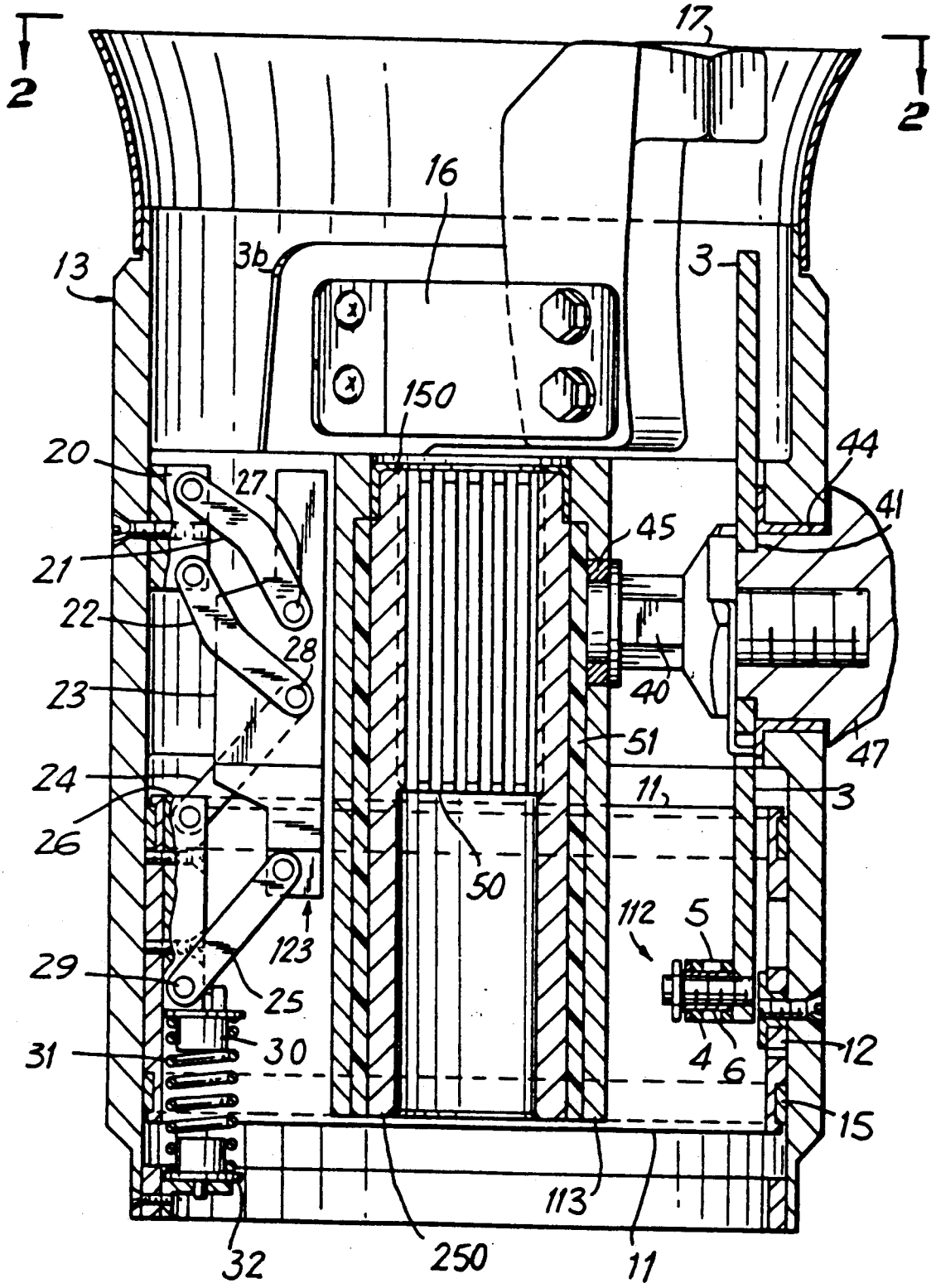
FIG. 4 is a cross-sectional view taken along lines 4—4 of FIG. 3.
Figure 4A:
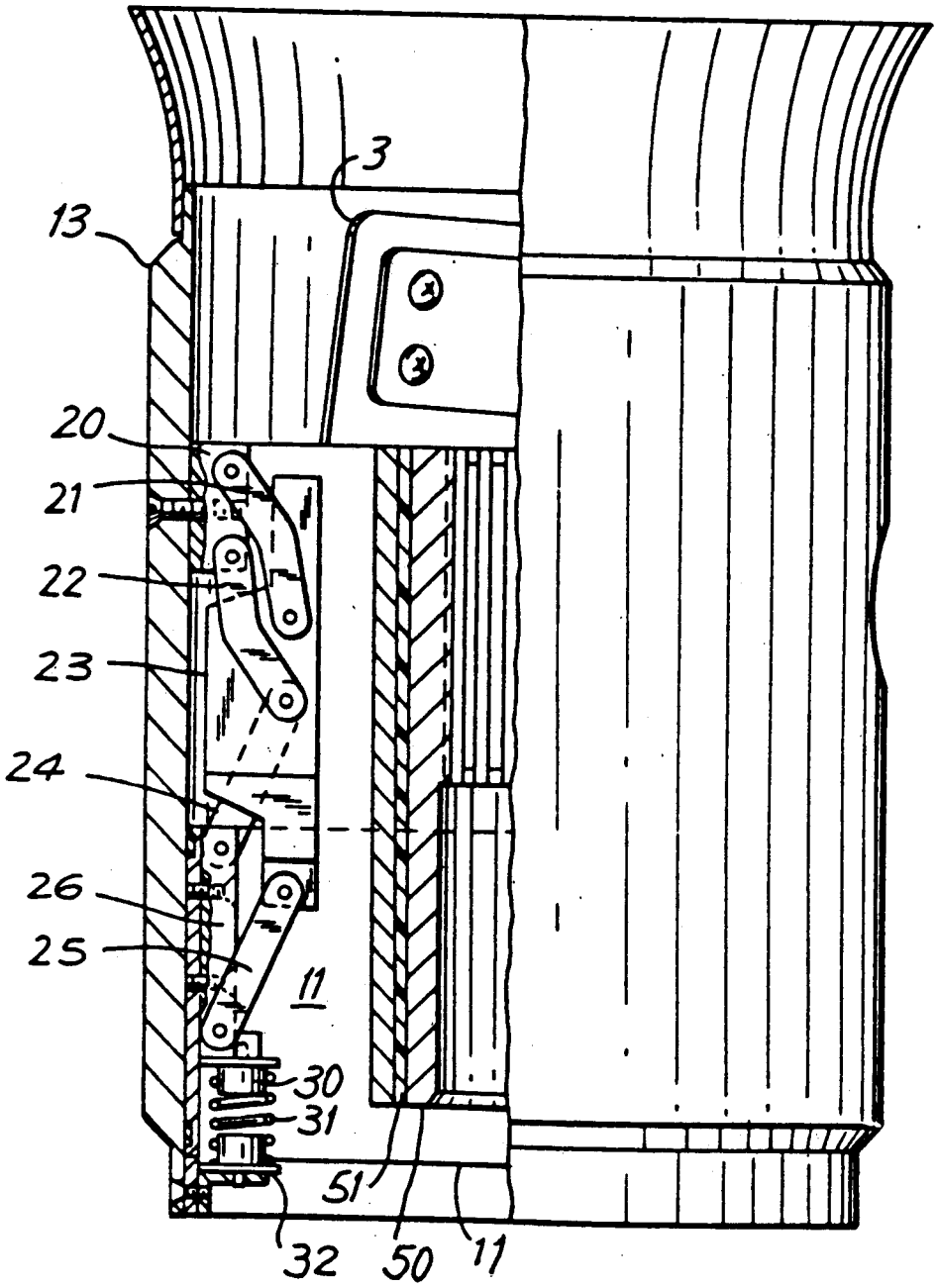
FIGS. 4*a* and 5*a* are high pitch-position representations of the views of FIGS. 4 and 5, respectively.
Figure 13:
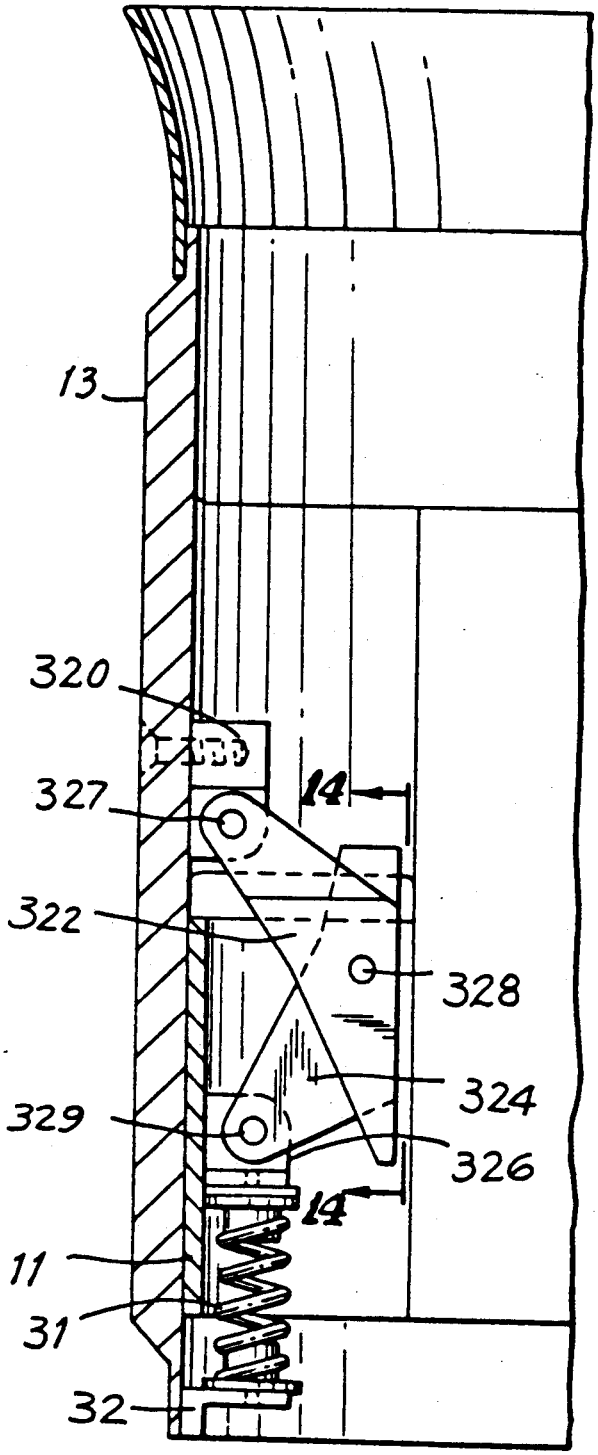
FIG. 13 and 13*a* each is a partial longitudinal cross-sectional view of another embodiment of this invention, showing the device in a low pitch position and high pitch position, respectively.
Figure 13A:
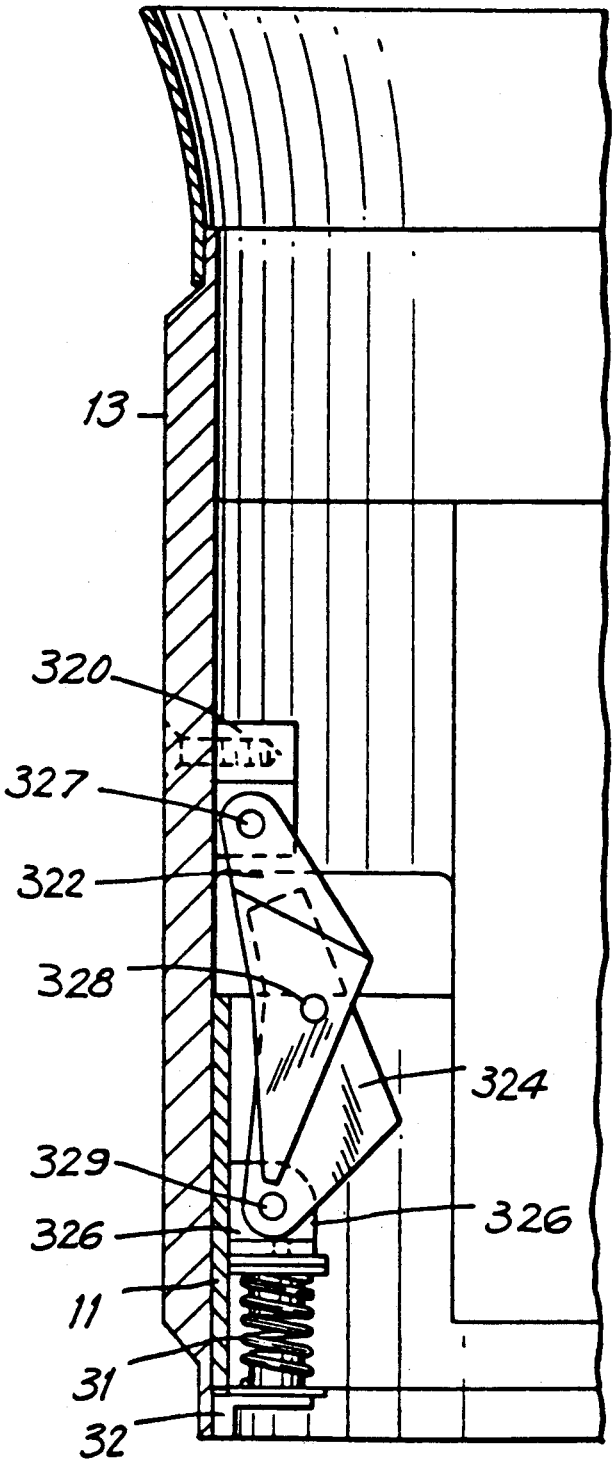
Figure 15:
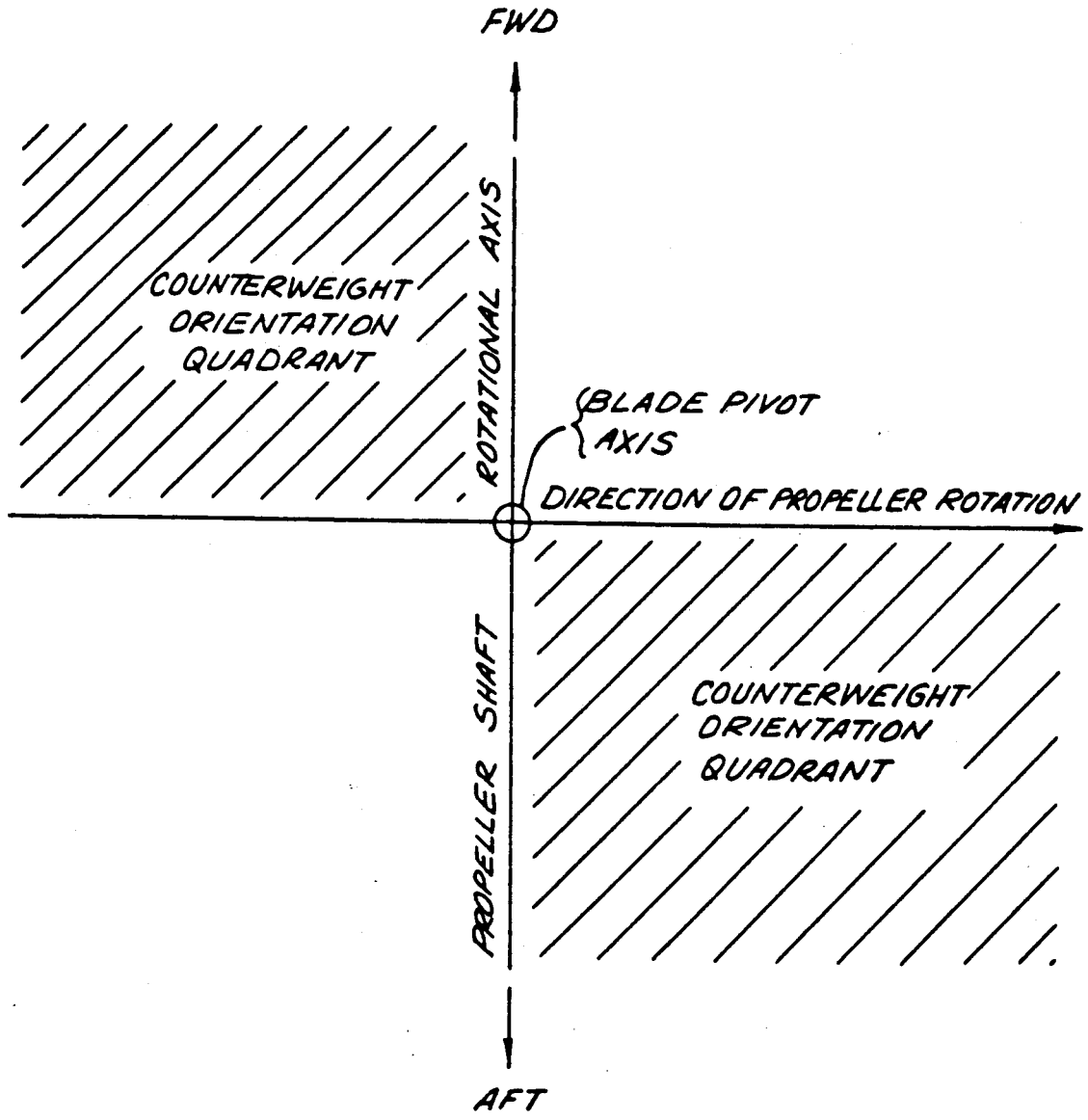
FIG. 15 is a vector diagram for the operation of the propeller of this invention, viewing radially inward along the blade pivot axis Y—Y.
Figure 16:
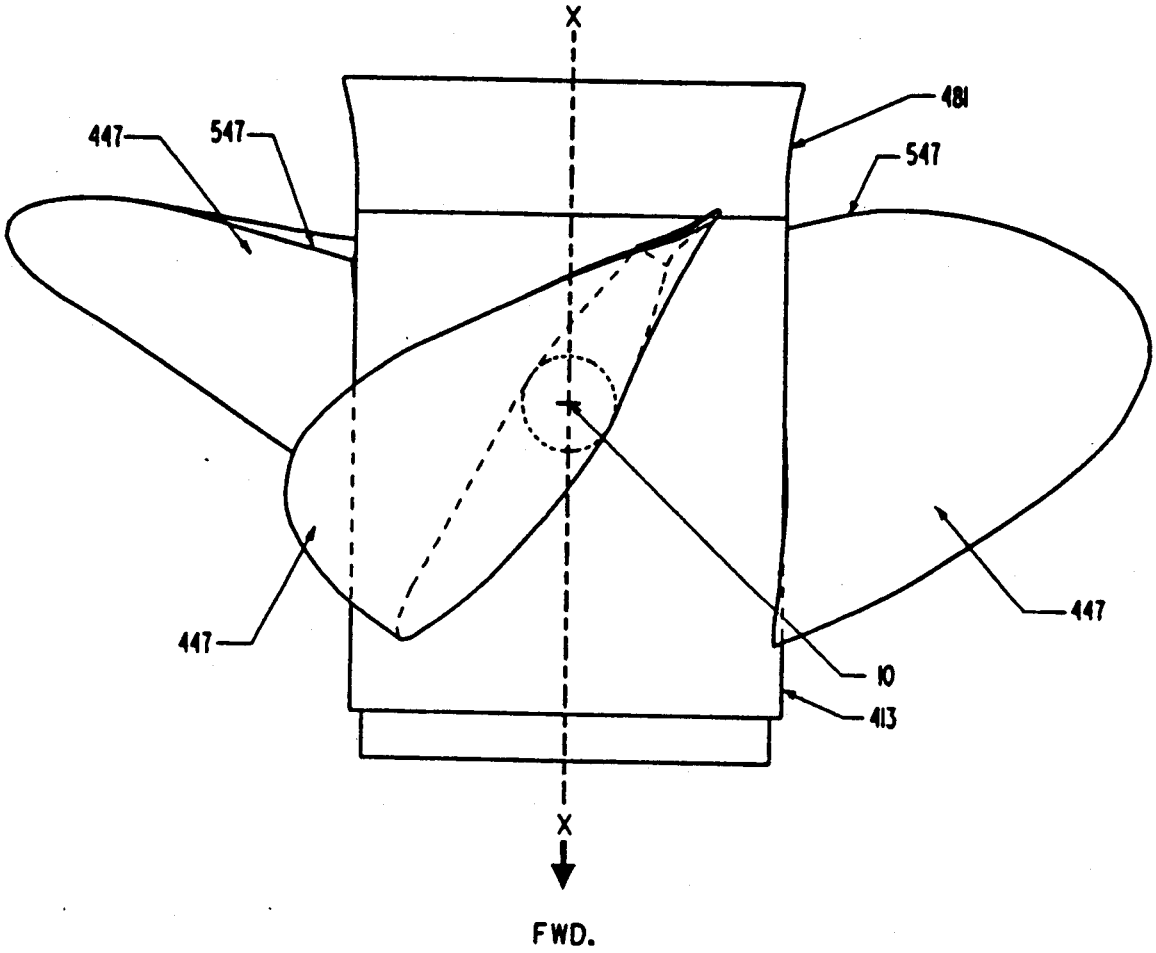
FIG. 16 is a side elevation view of the propeller assembly.

An alternate arrangement of the actuating weight mechanism shown in FIGS. 4 and 4*a*, is shown in FIGS. 13, and 13*a*. In this alternate arrangement fewer parts are used, but the function of the mechanism is the same. The inertial actuating weight mass is provided integrally on the toggle links 322, 323, 324. At rest, the linkage is biased by the spring force towards the low pitch position of FIG. 13. The spring 31 acts between its main support 32, rigidly secured to the hub 13, and the slider block 326 secured to the coordinating ring 11. Links 322, 323 are pinned to the slider block 326, and link 322 is pinned to the hub block 320. The second end of all the links 322, 323, 324 are pinned together by pin 328. For the alternate embodiment of FIG. 13, 13*a*, and 14, the operation of the mechanism is as follows:

As the engine speed increases, and the rotational speed of the propeller assembly increases, centrifugal forces acting on the mass of links 322, 324, and 323 also increase, causing the links to rotate radially outwardly about pivots 327 and 329 and towards the outer hub 13. The toggle links 322, 324, 323 are biased towards the radially inward position (shown in FIG. 13) by the spring force of spring 31 acting against the coordinating ring 11, which in turn acts through the toggle links 324, 322, 323. As the centrifugal force exerted by the links 322, 323, 324 increases, it acts in a direction opposite to the biasing force of the spring 31. When the centrifugal force exceeds the spring 31 pre-load bias force, the locking mechanism 112 over-center force component, and friction, the links 324, 322, 323 move radially outward, thereby causing pivoting of the links about the pivot centers 327, 328, 329 and push against the slider block 326; this causes the axial movement of the coordinating ring 11 in a forward direction, to the high-pitch position, against the pre-load force of the spring 31. The high-pitch position, for the actuating mechanism and the coordinating ring 11, is shown in FIG. 13*a*.

The links 324, 322, 323 are so designed as to increase the mechanical advantage of the net actuating weight as the links swing outwardly, i.e., towards the hub case 13, thereby increasing the force acting on the coordinating ring 11 in opposition to the bias force of spring 31. Thus, the increase in inertial force generated by the net actuating weight of links 324, 322 323 as they swing outwardly is greater than any increase in the spring rate of the spring 31, thereby insuring a continuous and smooth forward movement of the coordinating ring 11. Further insuring this smooth movement of the ring 11 is the reduction in the effect of friction, i.e., from static friction to sliding friction, and the release of the locking linkage 112.

The rotation of the entire propeller assembly also results in the generation of a centrifugal inertial force on the counter weights 17 secured to the rear-most end of each blade arm 3. The counter weights 17 are so oriented relative to the blade pivot axis y-y, that the centrifugal forces acting on the counter weights 17 generate turning moments ("$M_{cw}$") about the blade pivot axis directed toward rotating the blades 17 toward a higher pitch angle.

Figure 14:
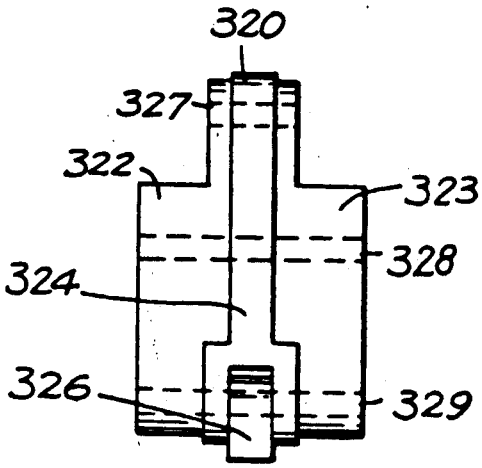
FIG. 14 is a cross-sectional view taken along lines 14—14 of FIG. 13.

To be effective, the counterweights must be positioned such that their center of gravity and mass distribution are in one of two preferred quadrants relative to the blade pivot axis and propeller shaft axis; see FIG. 14. The location of the counterweight center of gravity is positioned either aft of the blade pivot center, relative to the shaft axis, and offset toward the direction of propeller rotation relative to the pivot axis or, alternately, positioned forward of the blade pivot axis, relative to the shaft axis, and offset opposite to the direction of propeller rotation relative to the pivot axis. When the counterweight center of gravity (and mass distribution) is placed in these preferred quadrants, the mass inertial forces tending to align the counterweight mass in a plane normal to the shaft axis will complement the desired bias toward higher pitch as the counterweight moves radially outward. Conversely, if the counterweight center of gravity is positioned in either of the two non-preferred quadrants, this mass inertial component will oppose the desired bias toward high pitch.

An approximate magnitude of the inertial turning moment for the counter-weights can be obtained from the following equation (which is a simplification of Equation 4, above).

$$M_{cw}=Xd(mW^2), \tag{5}$$

wherein X is the shaft axial distance between the counterweight c.g. (assuming all of the mass is concentrated at that point) and the blade pivot axis y-y (ins); d is the offset distance to the counter-weight center of gravity from the propeller shaft rotational axis (ins.); m is the counter-weight mass (lbs.), and W is the propeller rotational velocity (radius per second).

As the rotational velocity of the propeller assembly and boat speed increases, the centrifugal force turning moments generated by the counter weights 17 ($M_{cw}$) increase until they exceed the sum of the opposing forces, i.e., the inertial turning moments generated by the blades 47 ($M_B$), plus the resultant hydrodynamic turning moment ($R'_g$) acting on the blades 47, plus any internal friction.

Empirical results have shown that for the particular design system shown in these drawings, the counterweight mass can be in the range of from about 50% to about 150% of the mass of the blade, and preferably from about 60% to about 90%. There should be a relatively low co-efficient of friction, i.e., less than 0.3, such as is obtained when metal parts are in contact with plastic bushings, such as of acetal resin e.g. Delrin. More generally, $M_{cw}$ is preferably about two to about four times larger than $M_B$, when the pitch shift occurs towards higher pitch.

Upon the release of the bell crank linkage locking mechanism 112 by the displacement of the coordinating ring 11, the propeller blades 47 are allowed to turn to the high pitch position as soon as the turning moment $M_{cw}$ in that direction exceeds the moments acting in the opposite direction. Thus, as the propeller rotational speed increases, and the center of pressure of the resultant hydrodynamic force moves toward the blade trailing edge 247, reducing the feedback locking load, the blades 47 will then turn to the high pitch position. The movement of all of the blade arms 3 is coordinated through the bell crank linkages 112 and the axial travel of the coordinating ring 11, such that all three propeller blades 47, in this embodiment, rotate substantially simultaneously and equally.

Figure 5A:
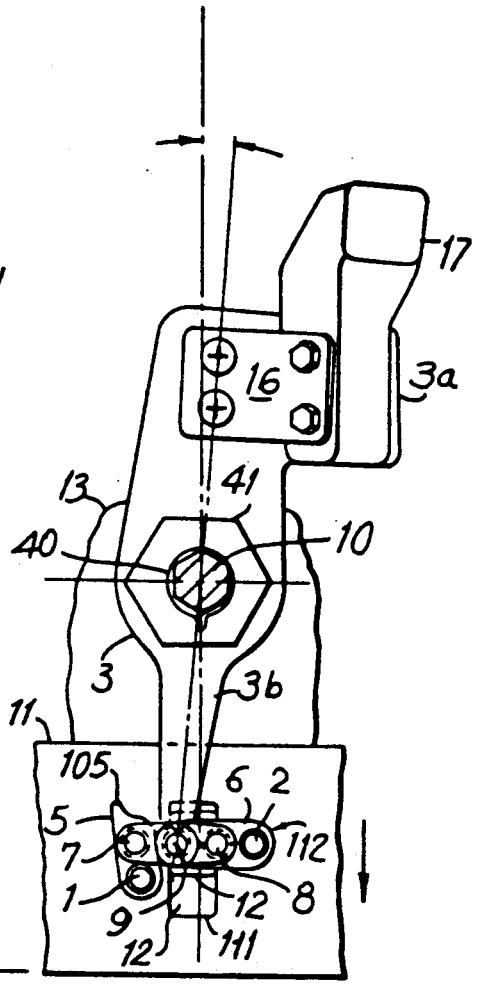

The rotation of each of the blades 47 terminates as soon as the bell crank linkages 112 are each in the position shown in FIG. 5*a*; the linkage 112 is in an over-center locked position, preventing further movement of the blade arm 3, about its pivot point 10, in either direction. In this case, the over-center locking angle is determined by the stub 106 on the end of the other link 6, abutting against the bell crank pin 9. The angular distance moved on either side of the axial plane, as indicated by the angle alpha ($\alpha$) in FIG. 5 and theta (0) in FIG. 5*a*, need not be equal.

When locked into the high pitch position, any turning moment on the blades back towards the low pitch position is resisted by the force translated through blade arm 3, the pins 7, 8 and the links 4, 6 to the anchor pin 2. Again, the force on the anchor pin 2, tending to rotate the coordinating ring 11, is opposed by the other surface of the slide bearing 12 within the slot 111 in the coordinating ring 11.

Upon deceleration of the boat and engine and reduction of the rotational speed of the propeller, at the point that the sum of the centrifugal force component generated by the actuating weight 23, plus the force component of the locking mechanism 112, plus friction, is exceeded by the spring force component exerted by the return spring 31, the coordinating ring 11 starts to move axially rearwardly. This unlocks the bell crank assemblies 112, permitting the blade arms 3 to rotate together with the blades 47 towards the low pitch position, as soon as the centrifugal force exerted by the counterweights 17 is exceeded by the net turning moment on the blades 47 tending towards the low pitch position. Again, the coordinating ring 11 acting along with the blade arms 3, causes the blades 47 to all rotate substantially simultaneously and equally. To reduce friction and to promote even and regular movement of the coordinating ring 11, thin, low friction material (e.g. Teflon) glide rings 15 are provided around the outer surface of the coordinating ring 11.

It is noted that the structural drawings are drawn to scale. In the illustrated example of FIGS. 1–14, the propeller diameter is 14.3 ins., and the hub diameter is 4.6 ins. The weight of each blade 47 is 13 oz., the blade plan form area is 27 ins., and the length of the blade arm 3 is 2.28 ins. The counter-weight 17 weighs 8 oz., the shaft axial distance, X, between the counter-weight center of gravity ("c g.") and blade pivot axis Y-Y is 2.37 ins.; and the offset distance, d, of the counterweight c.g. is 1.62 ins., when in the low pitch position. The activating weight 23 weighs 3 oz. and its c.g. is located 1.24 ins. radially from the hub centerline when in the low pitch position. The biasing spring 31 has a spring constant of 22 lb./in and is compressed to provide an initial preload of 8 lbs in the low pitch position.

When the locking mechanism over-center angle is about 2 degrees, the difference in the upshifting point propeller speed between light engine load and heavy engine load is about eighteen percent, e.g., from about 1700 rpm to about 2000 rpm.

The angular displacement of the blades from low to high pitch position is approximately 8 degrees. When positioned in the low pitch position, the propeller performance is comparable to that provided by a 14-inch pitch fixed pitch propeller, and when positioned in the high pitch position, the propeller performance is comparable to that provided by an 18-inch pitch fixed pitch propeller, for propellers having equivalent hydrofoil geometry.

These drawings show preferred embodiments comprising a locking linkage and actuating mechanism associated with each blade, e.g., three blades 47, three locking linkages 112, and three actuating, or lock-releasing, mechanisms 123. However, the numbers of blades, locking linkages and actuating mechanism, need not be equal Turning to the improved embodiment of this invention shown in FIGS. 17 through 26, retaining pin 441 rigidly secures each blade shank 440 to a support collar 460, located around the blade shank 440, intermediate the two bearing supports 444, 445. The retaining pin 441 also pivotably connects a yoke 461 to the blade shank 440/collar 460 assembly. Rigidly attached to the yoke 461 is an arm 403, which extends generally axially aft within the hub case 413, and is slidably secured through a spherical ball 419, which is rotatably held within a bell crank link 404. Located within and concentric with the hub case 413 is a coordinating ring 411, rotatably held against the inner surface 482 of the hub case 413. Each arm 403 is located radially inwardly of the coordinating ring 411 and is pivotally movable with the yoke 461.

These locking and positioning mechanisms, generally indicated by the numeral 512, also comprise four-bar linkages, a bell crank linkage assembly 512 (shown in enlarged detail in FIGS. 25 and 26), which comprises a bell crank 404, as a central link, and two end links 405, 406. The inner end of each of the two end links 405, 406 is pivotally connected to an end of a bell crank 404 by a bell crank pin 407, 408. The outer end of a linear end link 406 is rotatably secured to the hub case 413 by an anchor pin 402, at an ear lug 487. A corner of the generally triangular end link 405 is secured by an anchor pin 401 to the hub web 486. The anchor pins extend substantially parallel to the hub axis, X.

The bell crank 404 is spherically rotatably and longitudinally slidably connected to the yoke arm 403 via a spherical joint, generally indicated by numeral 409. The spherical joint 409 comprises a ball 419 inserted into and rotatably slidably held within a spherical socket formed in the bell crank 404. The ball 419 is cylindrically slidably joined with the arm 403, which is slidably inserted through a channel coaxial with the polar axis of the ball 419.

The geometry of the bell crank linkage assembly 512 is such that in the low pitch locked position shown in FIGS. 17, 19, 21, 23, and 25, the anchor pin 401, the bell crank pins 407, 408 and the central bell crank spherical joint 409, each have their respective centers positioned substantially along a straight link-line. When in the high pitch locked position of FIGS. 18, 20, 22, 24 and 26, the other anchor pin 402, and the bell crank pins 407, 408 and the spherical joint 409, each have their respective centers positioned substantially along another straight link-line, one that is located radially outward of the low pitch straight link-line. Both of the low pitch and high pitch position link-lines extend transversely, in this preferred case substantially normal, to the pivot axis, Y, of the blade shank 440.

Any turning force exerted on the blade 447, tending to turn the blade about its axis, y, feeds back to the locking and positioning mechanism 512 and is transmitted via the blade shank 440, the collar 460, the pin 441 and the yoke 523, to the arm 403, so as to act against the bell crank link 404 along the link lines and towards the case 413, i.e., towards the case pin 401 when the blade is in the low pitch position, and towards the case pin 402, when the blade is locked in the high pitch position. As a result of this geometry, the locking effectiveness of the locking and positioning mechanism 512 is increased by this feedback effect from the blade.

A pitch change release and actuating mechanism, generally indicated by the numeral 523, serves to release the locking and positioning mechanism 512 from a locked position and rotate the blade 447. The release and actuating mechanism 523 consists of the yoke 461, the pivot pin 441, the blade shank collar 460, and the yoke arm 403, with the counterweights 417, and is so arranged that the yoke 461/arm 403 (with the counterweights 417) assembly is free to rotate about the axis of the yoke pin 441 without any effect on the blade 447; however, any rotational movement about the blade axis, y, i.e., about an axis transverse to the pin 441, can only be by the entire system including the pin 441, the yoke 461, the arm 403, the collar 460 and the blade shank 440, and thus changing the pitch of the blade 447.

The combined mass of the release and actuating mechanism 523, i.e., the yoke 461, the arm 403, and the counterweight 417 secured to the rearmost end of the arm 403, and the ball 419, and of the radially movable portion of the locking mechanism 512, i.e., primarily the bell crank 404 and the pivot pins 407 and 408, provides a net actuating mass which generates a centrifugal inertia force reaction, when the propeller is spinning about its axis, X, in direct proportion to the square of the propeller rotation speed. A component of the centrifugal inertial force reaction acts radially outwardly, i.e., tending to move the bell crank link 404 out of its locked low pitch position and towards its high pitch position. The net centrifugal force can be varied by varying the masses of the counterweights 417.

Figure 2:
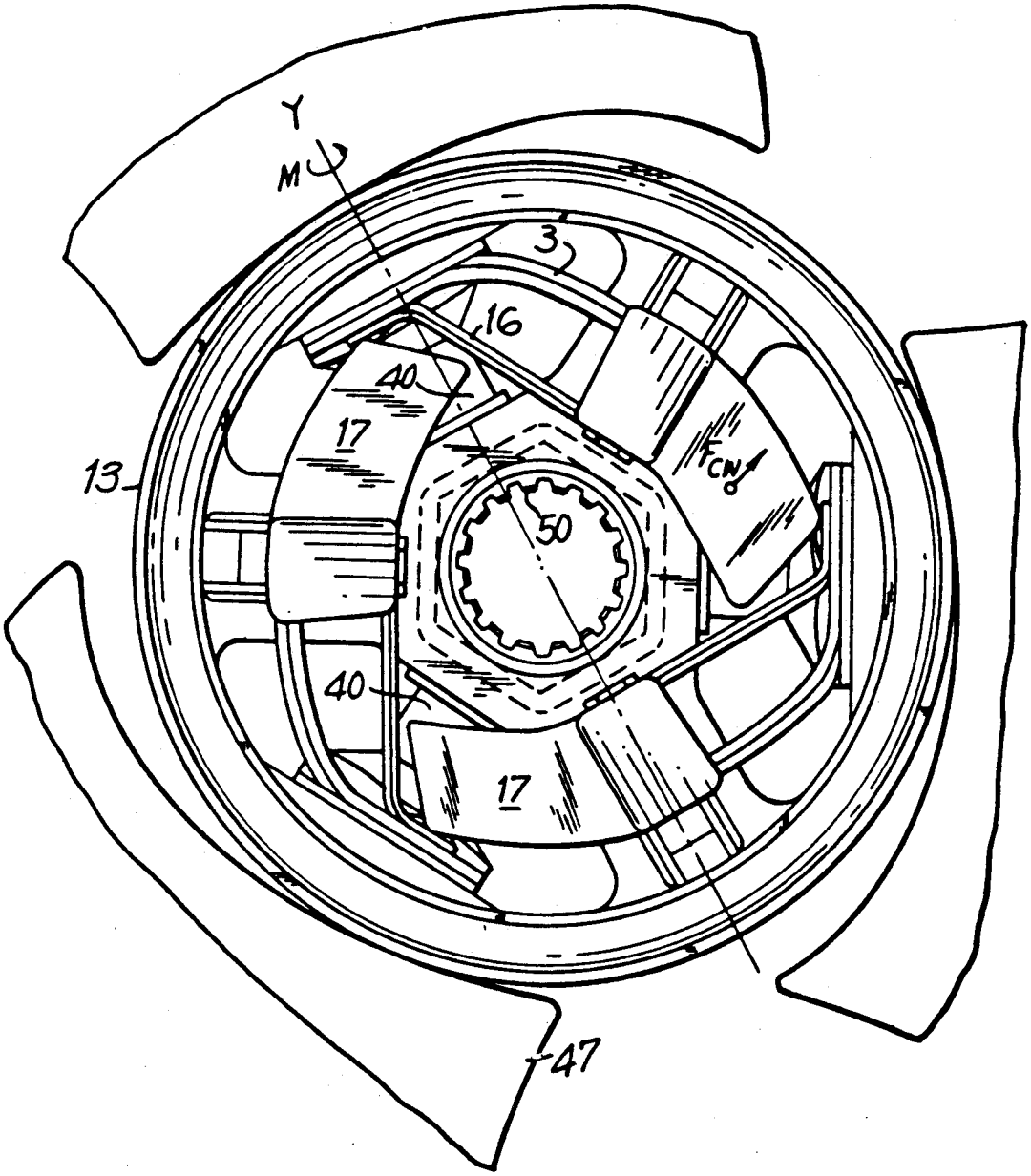
FIG. 2 is a rear end view of the variable pitch marine propeller of FIG. 1.
Figure 3:
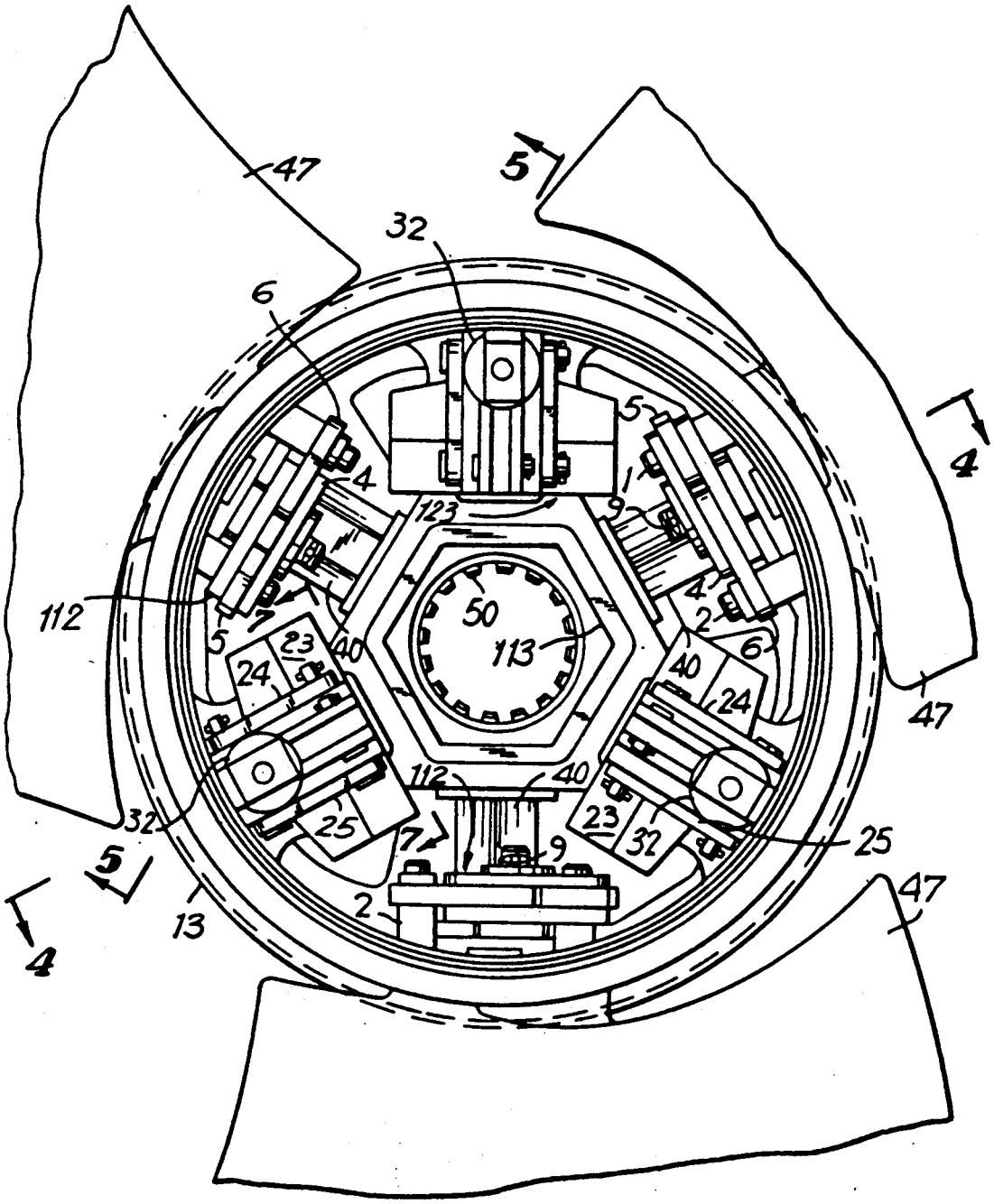
FIG. 3 is a front end view of the variable pitch marine propeller of FIG. 1.

The net centrifugal force reaction has two useful vector components: one which acts in a direction tending to move the yoke arm 403 both radially outward and a second acting tangentially in the direction of propeller rotation. It has been determined empirically, that the center of gravity of each counterweight 417, when the system is in the locked low pitch position of FIGS. 2 and 4, is preferably located at an angle of between about 10 to about 30 degrees and most preferably at about 15 degrees from the blade shank pivot axis, Y. It has also been empirically determined that the actuating system has a mass equal to from about 60% to about 120% of the blade mass (including the blade shank).

As a result of this geometry, the bell crank 404 is caused to pivot radially outwardly from the locked low-pitch position by the radial component of the centrifugal reaction force, and in response to the tangential components of the centrifugal inertia reaction force, the yoke arm 403/yoke 401 assembly is caused to pivot transversely, i.e., about the blade axis y, rotating the blade 447 about its pivot center 10, from the locked, low pitch position to the high pitch position.

A pair of actuator biasing springs 431, 433 are connected between each bell crank link 404 and a location adjacent the inner hub 513. The first coil spring 431 is pinned at one end to a post 432, secured to an ear lug on the inner hub 513, and at its second end to a first crank post 429 on the bell crank 404; the second coil spring 433 is pinned to a second post 432 secured to another ear lug on the inner hub 513, at one end, and to a second crank post 434 on the bell crank 404. The two crank posts 429, 434 are secured to the bellcrank link 404 at opposite sides of the arm 403, adjacent the link pins 407, 408, respectively. The springs 431, 433 all act radially inward and opposite to the centrifugal inertial force reaction.

The biasing springs can be placed between any two of these locking means components having relative motion. For example, as shown in FIGS. 33–40, biasing springs 531 can be connected between two adjacent bell crank links 504 (or 404) via pins 529 and 572. Alternatively, the bias springs can be connected between the hub 413 and the coordinating ring 511 (or 411), as in FIG. 32, or between actuating arms 403.

Figure 17:
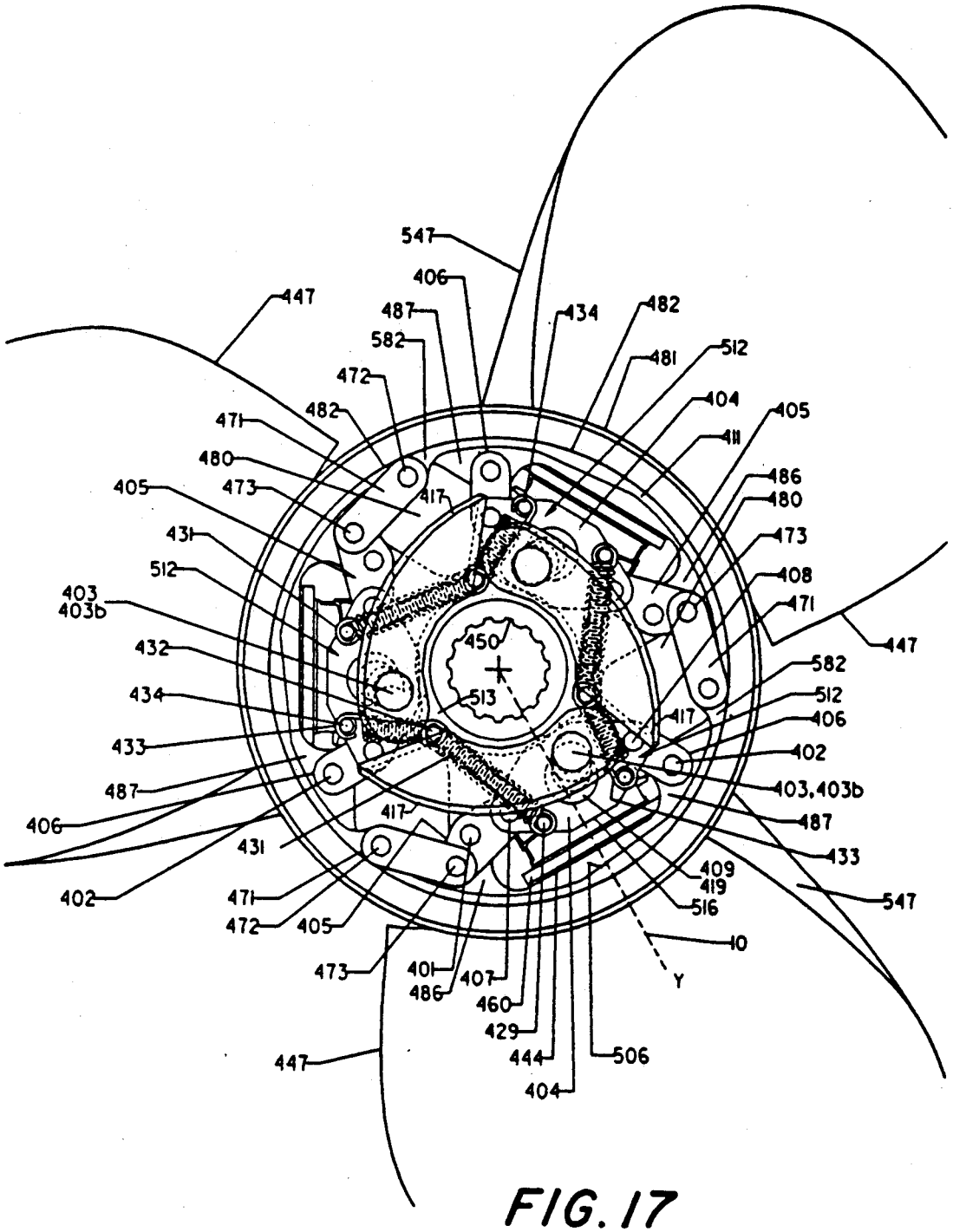
FIG. 17 is a rear view of one embodiment of the propeller assembly having an outer diameter coordinating ring, with the internal mechanism in the low pitch position.
Figure 18:
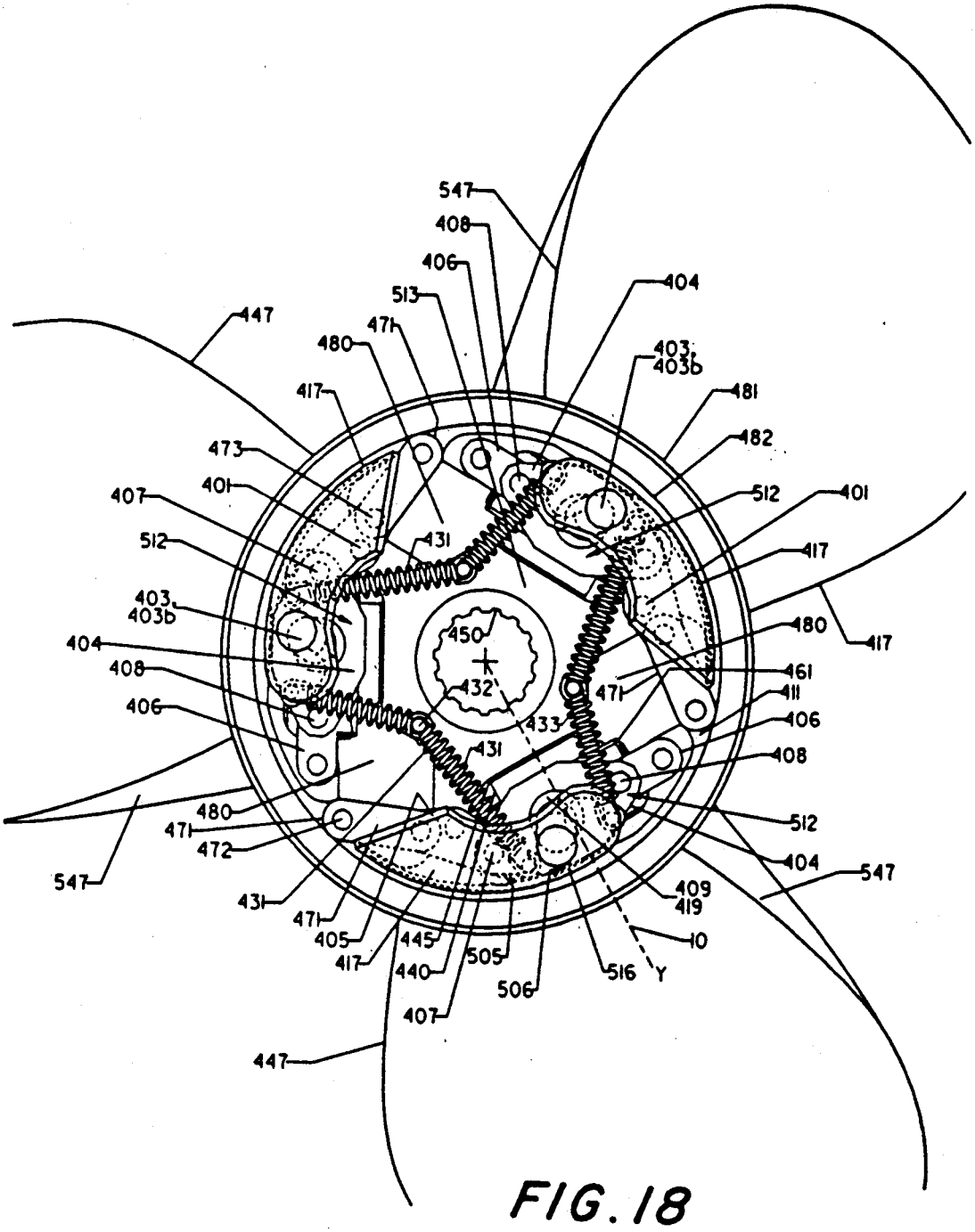
FIG. 18 is a rear view of the propeller assembly of FIG. 17 with the internal mechanism in the high pitch position
Figure 19:
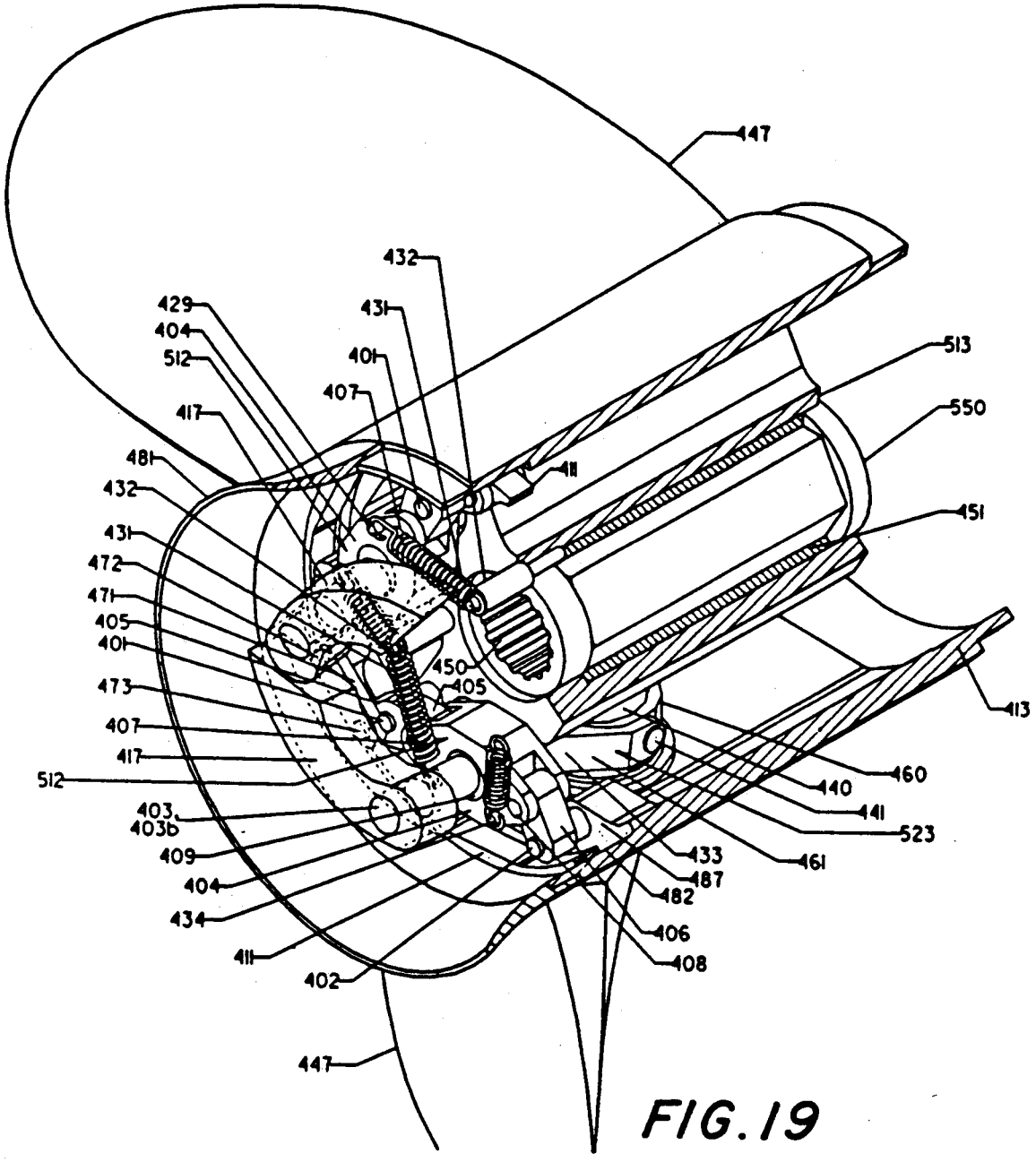
FIG. 19 is a sectional isometric view of the propeller assembly of FIG. 17 with the internal mechanism in the low pitch position.
Figure 20:
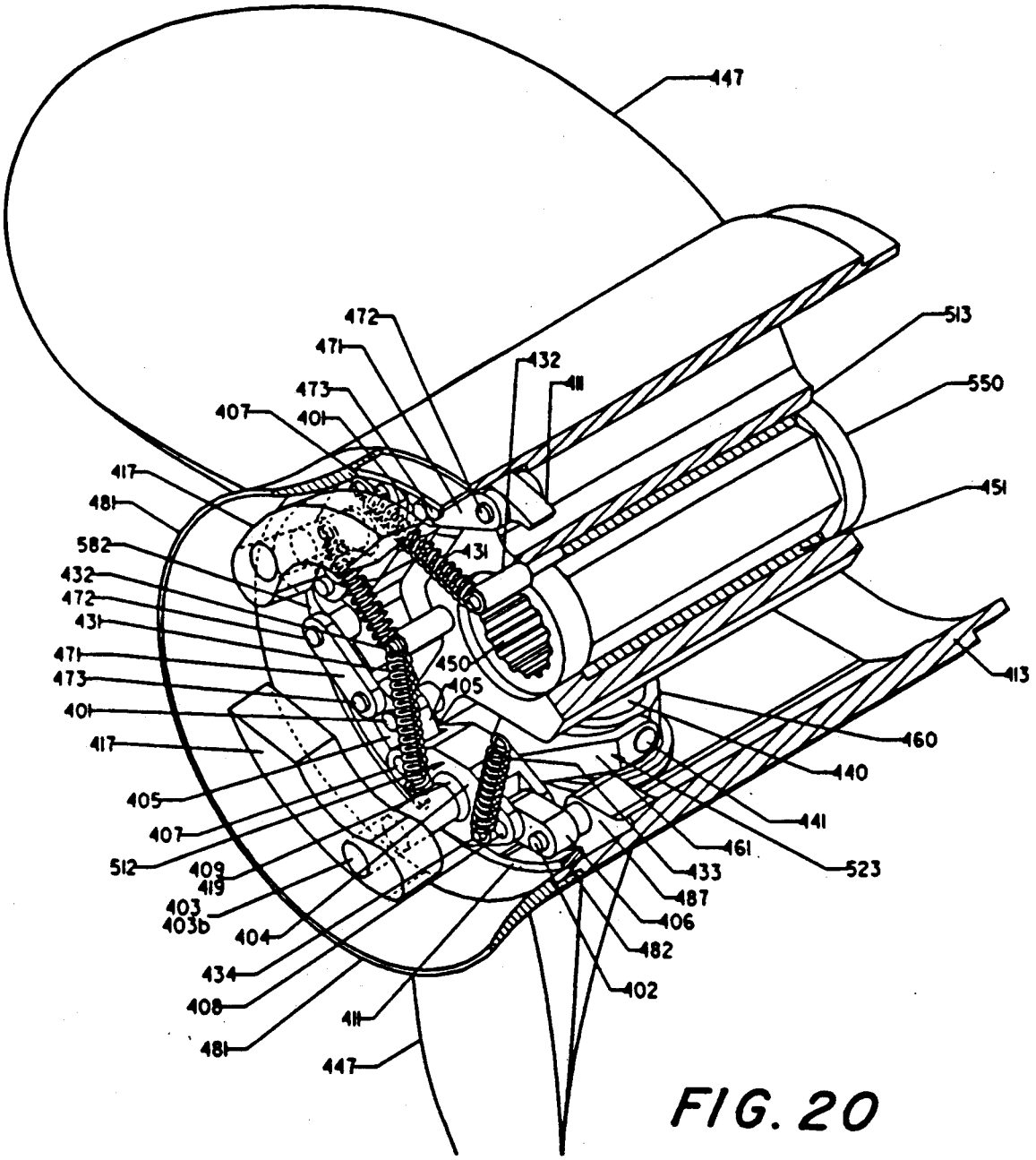
FIG. 20 is a sectional isometric view of the propeller assembly of FIG. 18 with the internal mechanism in the high pitch position.
Figure 21:
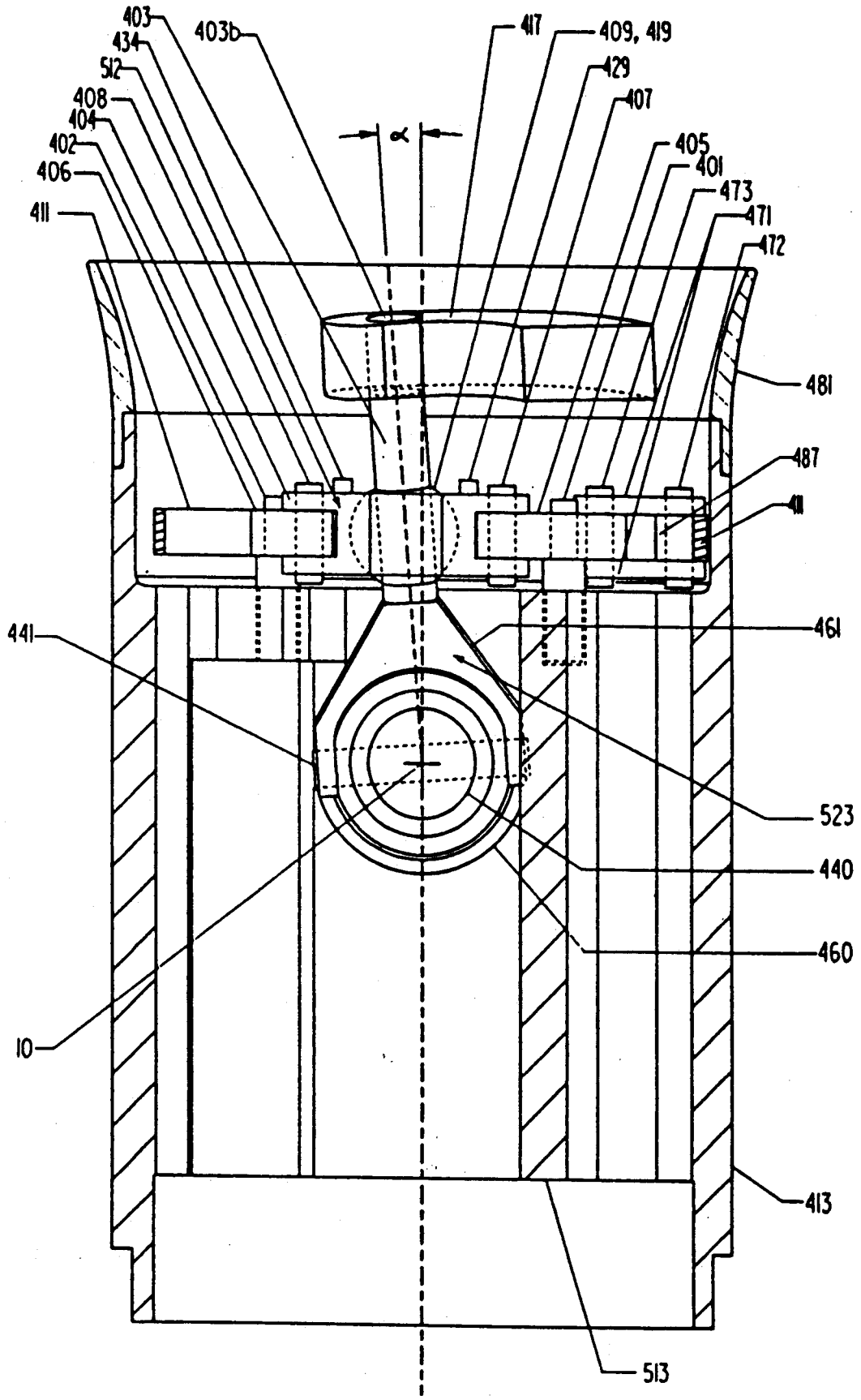
FIG. 21 is a random sectional view looking radially outward showing the mechanism components for one blade, with the components in the low pitch position.
Figure 22:
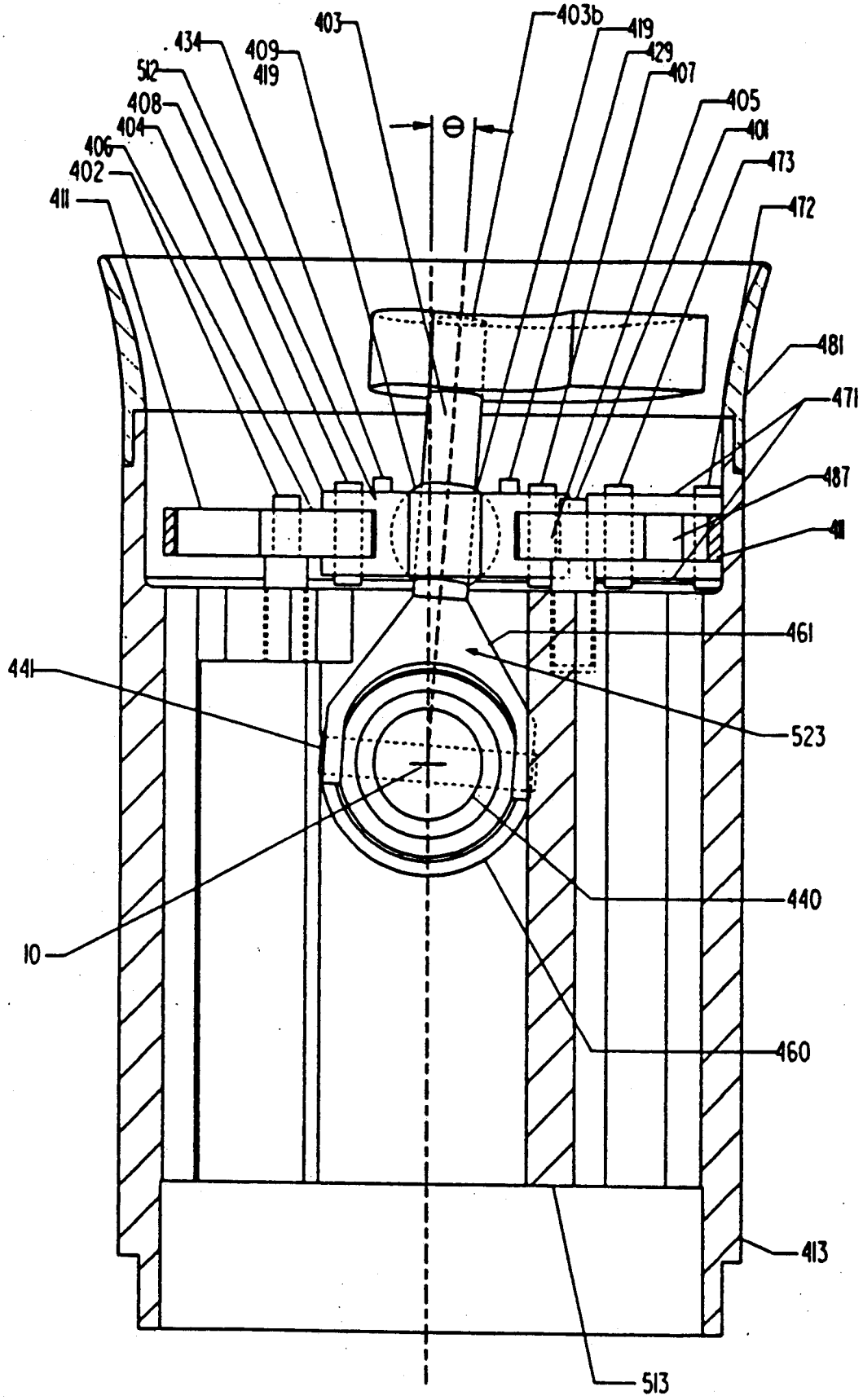
FIG. 22 is the same random sectional view as in FIG. 21, looking radially outward showing the mechanism components for one blade, with the components in the high pitch position.
Figure 23:
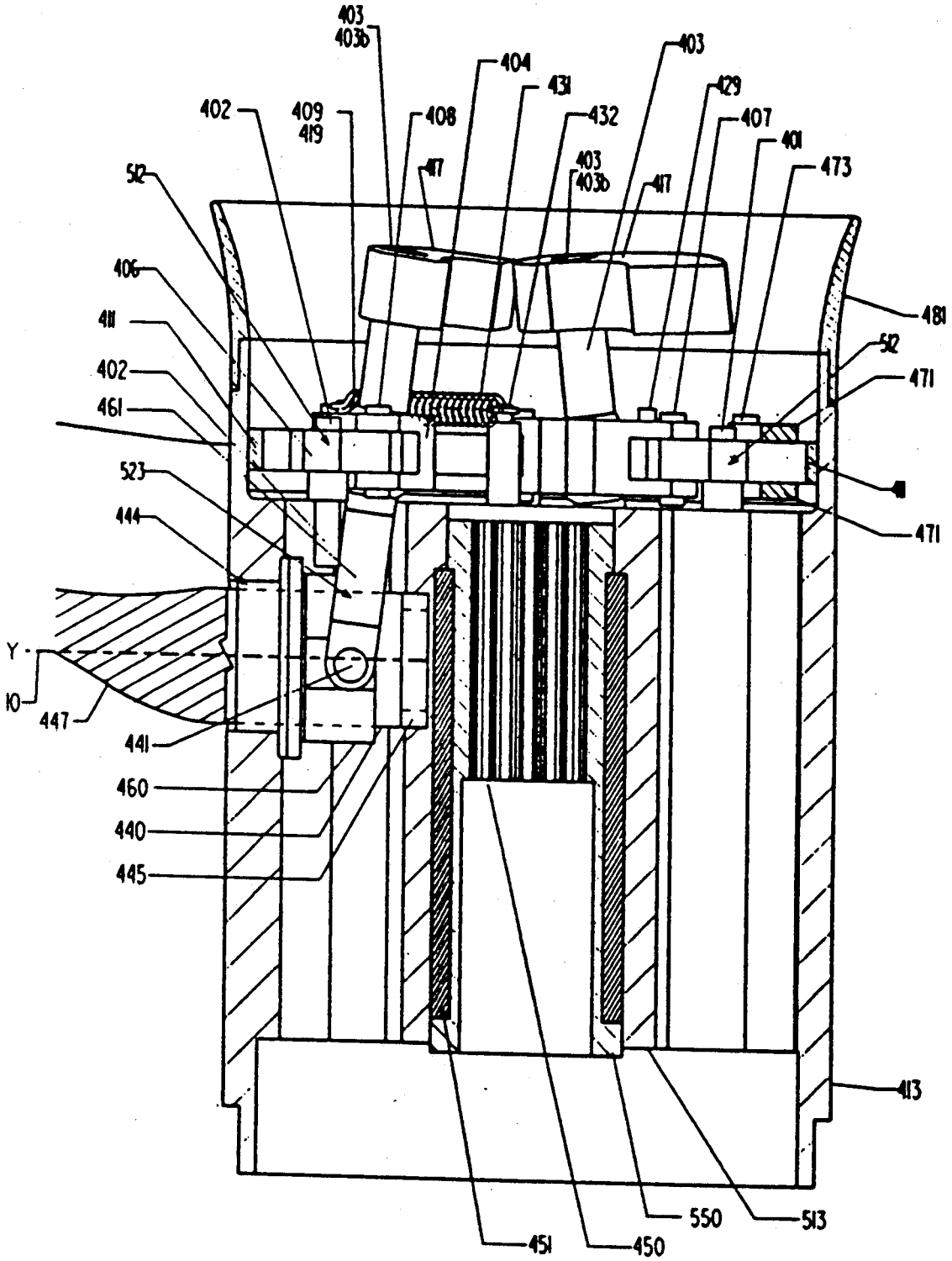
FIG. 23 is a longitudinal sectional view, taken along lines 8—8 of FIG. 17, showing the propeller components assembly of FIG. 17 in the low pitch position.
Figure 24:
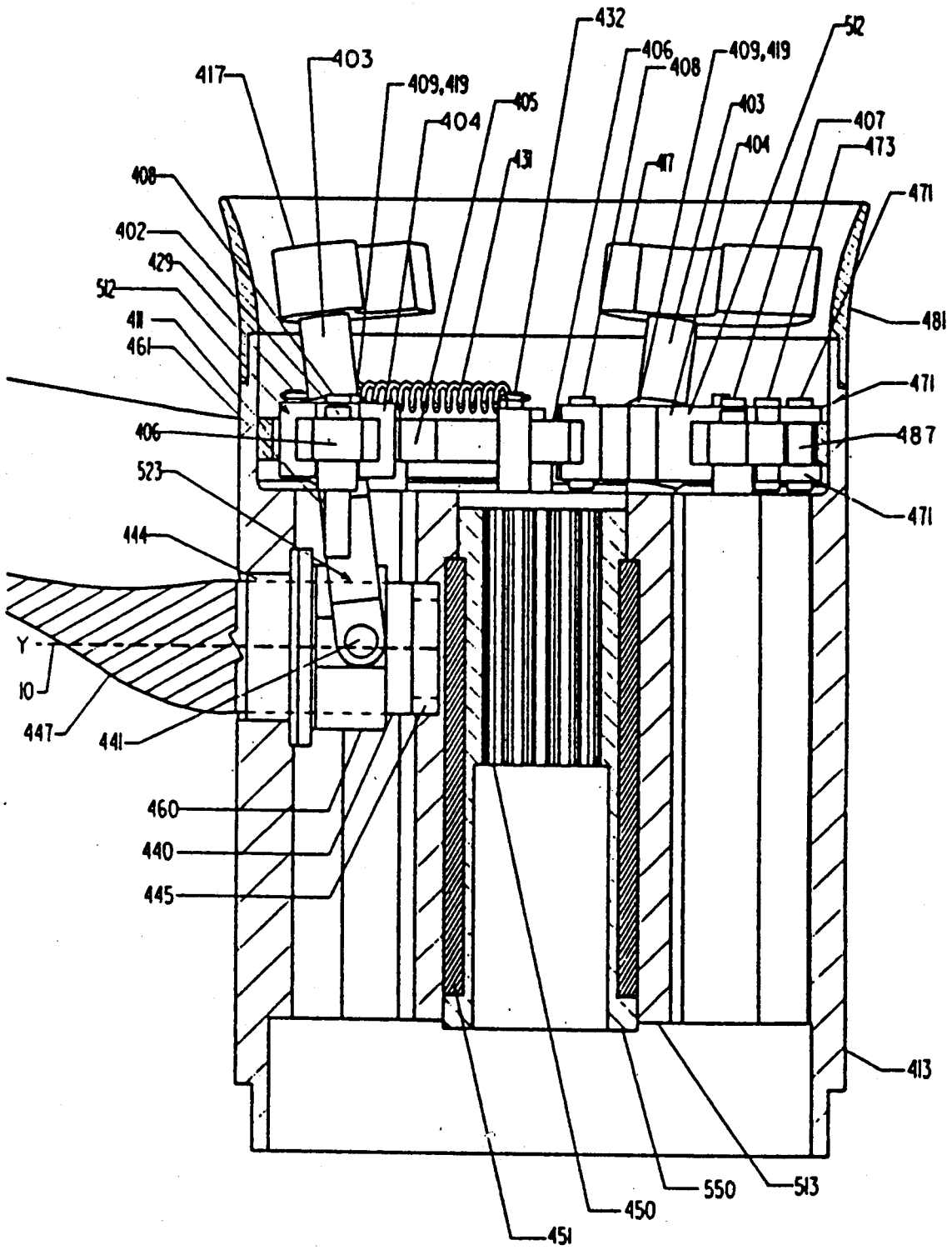
FIG. 24 is a longitudinal sectional view, taken along lines 9—9 of FIG. 18, showing the propeller components assembly of FIG. 18 in the high pitch position.

For the arrangement of FIG. 17, the spring biasing force generated in spring 431 primarily effects the timing of the release out of the locked low pitch position, or "up" shift into the high pitch position, while the biasing force generated in spring 433 primarily effects the timing of the release out of the locked high pitch position, or "downshift" back into the low pitch position. Springs 431 and 433 for adjacent blade system are shown as connected to a common mounting post 432, however separate mounting posts can be provided to allow for more independent adjustment of the biasing force within each spring 431 and 433.

The movements of all three of the blade pitch actuating mechanisms 523 shown in FIGS. 17–26, are coordinated so that all of the blades 447 change pitch, or pivot, in unison. This is accomplished by a coordinating mechanism, in this embodiment consisting of the coordinating ring 411, which is connected to each blade locking mechanism 512. This forms a second four-bar linkage system, comprising the ring 411, the connecting link 471, the outer portion of the triangular end link 405, and the case (at pin 401).

The coordinating ring 411 extends about the inner surface of the outer hub case 413, and is connected to each end link 405 via its respective connecting link 471 and its two pivot pins 472, 473; one pivot pin 472 is secured to the coordinating ring 411 at a ring ear lug 582 such that the connecting link 471 cannot move (other than pivoting about the pin 472) unless the coordinating ring 411 also moves. As the bell crank 404 moves radially outward, the end link 405 rotates about its anchor pin 401, causing movement of the connecting link 471 which is pivotally attached to the end link 405. Movement of any of the connecting links 471 causes the coordinating ring 411 to rotate about the hub drive axis, X. As the coordinating ring 411 rotates, all of the other connecting links 471 must also move, thus activating all of the locking mechanisms 512, actuating mechanisms 523 and blades 447 to move in unison.

An alternate coordinating ring geometry is shown in FIGS. 33–36. In this arrangement, the coordinating ring 511 is also concentric to the propeller drive axis (X), but is placed at a radially inward diameter relative to the blade arm 403, adjacent the outer surface 582 of the inner hub 513. The coordinating ring 511 is rotatably held against the cylindrical outer surface 582 of the inner hub 513. A link 571 is connected between the coordinating ring 511 (pin 573 on ring boss 575) and each bell crank link 504 (at pin 573). An alternate locking and positioning mechanism 612 is formed by links 505, 504 and 406. Link 505 differs from link 405 (in FIGS. 17–26) in that it is linear and is connected to only two link pins 401, 407. The bell crank link 504 differs from bell crank link 404 (in FIGS. 17–26) in comprising an additional ear 574, to provide for the pin joint attachment to the ring connect link 571, at pin 572.

The geometry of the internal coordinating ring assembly shown in FIGS. 33–36 is such that as any one locking and positioning mechanism 612, including a bell crank link 504 is caused to move radially outwardly by the actuating mechanisms 523 (and/or 490), the connect link 571 causes the coordinating ring 511 to rotate about the hub drive axis X. As the coordinating ring 511 rotates, the other connect links 571 must also move, thus releasing all of the locking mechanisms 612, causing the actuating mechanisms 523 (and/or 490) and thus the blades 447 to move in unison. In this embodiment, a biasing spring 531 is connected between the bell crank links 504 of adjacent locking and positioning mechanisms 612, at pins 572 and 529.

A third embodiment of the propeller system of this invention is shown in FIGS. 37–40. In this embodiment, the direct acting counterweights are eliminated from the rearmost ends of moment arms 403; the centrifugal inertial reaction force is generated by pivotally securing a relatively massive secondary actuating link 491 between the hub case, at its major interior diameter, and the radially inward portion of the bell crank link 504. The arm 403 does not extend aft beyond the bell crank link 504. The massive secondary actuating link 491 has one end pivotally connected to an ear lug 487 on the hub case, by pivot pin 402. At an intermediate position along the massive actuating link 491, a pin joint 492 connects with one end of a secondary connecting link 493; the other end of the secondary connecting link 493 is pivotally connected at pin joint 494 to the bell crank link 504. The mechanism is otherwise substantially the same as the second embodiment of FIGS. 33-36.

The secondary actuating link 491 provides a separate lock release means, additive to the primary lock releasing force generated through the biaxial yoke/arm assembly, acting to move the locked bell crank linkage out of the locked position, independent of the blade assembly. In the embodiments of FIGS. 17-26 and 33-36, the lock release mechanism acts directly only through the yoke/arm assembly 403, 523 by the combined inertial effects of the counterweight 417, the actuating system mass and the biaxially movable yoke/arm 461. In this embodiment, the effect of the primary lock release mechanism is reduced by the elimination of the counterweight mass 417, which reduces the centrifugal force reaction effect.

The massive secondary actuating link 491 is biased radially inward, together with the locking mechanism 612 by the biasing springs 531. The effect of the mass of the secondary link 491 is enhanced by the mechanical advantage of the lever arm, created by the juxtaposition of the massive link 491, the secondary connecting link 493 and the bell crank link 504.

The geometry of the secondary actuating mechanism 490 is such that when the propeller begins to rotate, a centrifugal inertial force reaction is generated by the mass link 491. When a sufficient propeller rpm has been achieved, the centrifugal force component in the radially outward direction can overcome the radially inward spring force biasing component of springs 531, and any radially inward directed component of an inertial force generated by the blade and any remaining locking component from the blade resultant hydrodynamic force, causing the mass link 491 to pivot radially outward about pin 402. As the mass link 491 rotates outward, the locking and positioning mechanism 612 and the primary release and actuating mechanism 523 are also caused, via connect link 493 and pin joints 492 and 494, to move radially outward from the locked low pitch position towards the locked high pitch position, angularly moving the blade to the high pitch position. Conversely, as the propeller rpm is decreased, the centrifugal force reaction component of the mass link 491 decreases until the radially inward spring biasing force provided by springs 531 plus the inertial force component of the blades exceeds the centrifugal force reaction component in the radially outward direction, causing the actuating mechanism 523, and the blade, to rotate back into the locked low pitch position.

Figure 32:
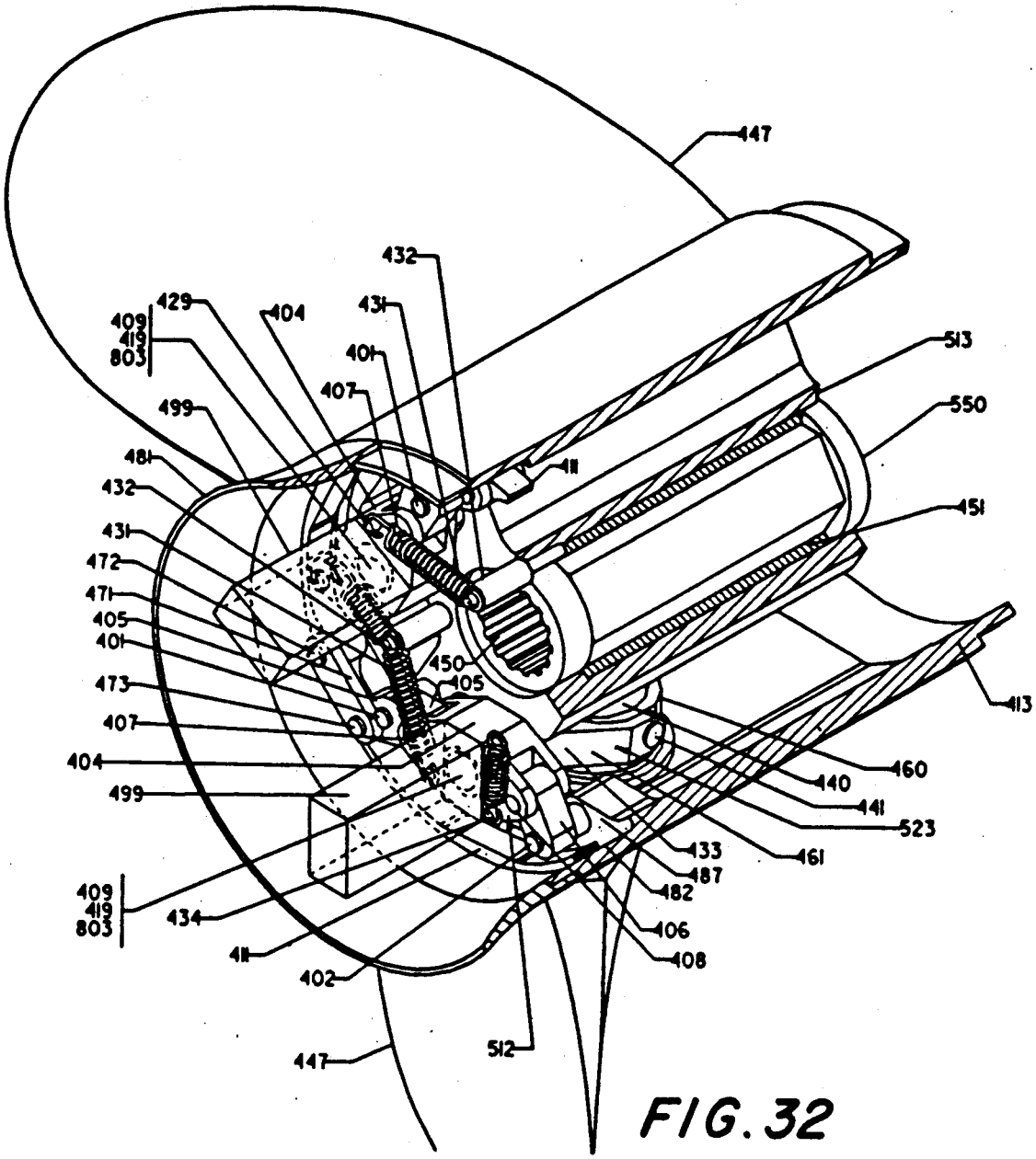
FIG. 32 is an isometric section of another propeller assembly.
Figure 33:
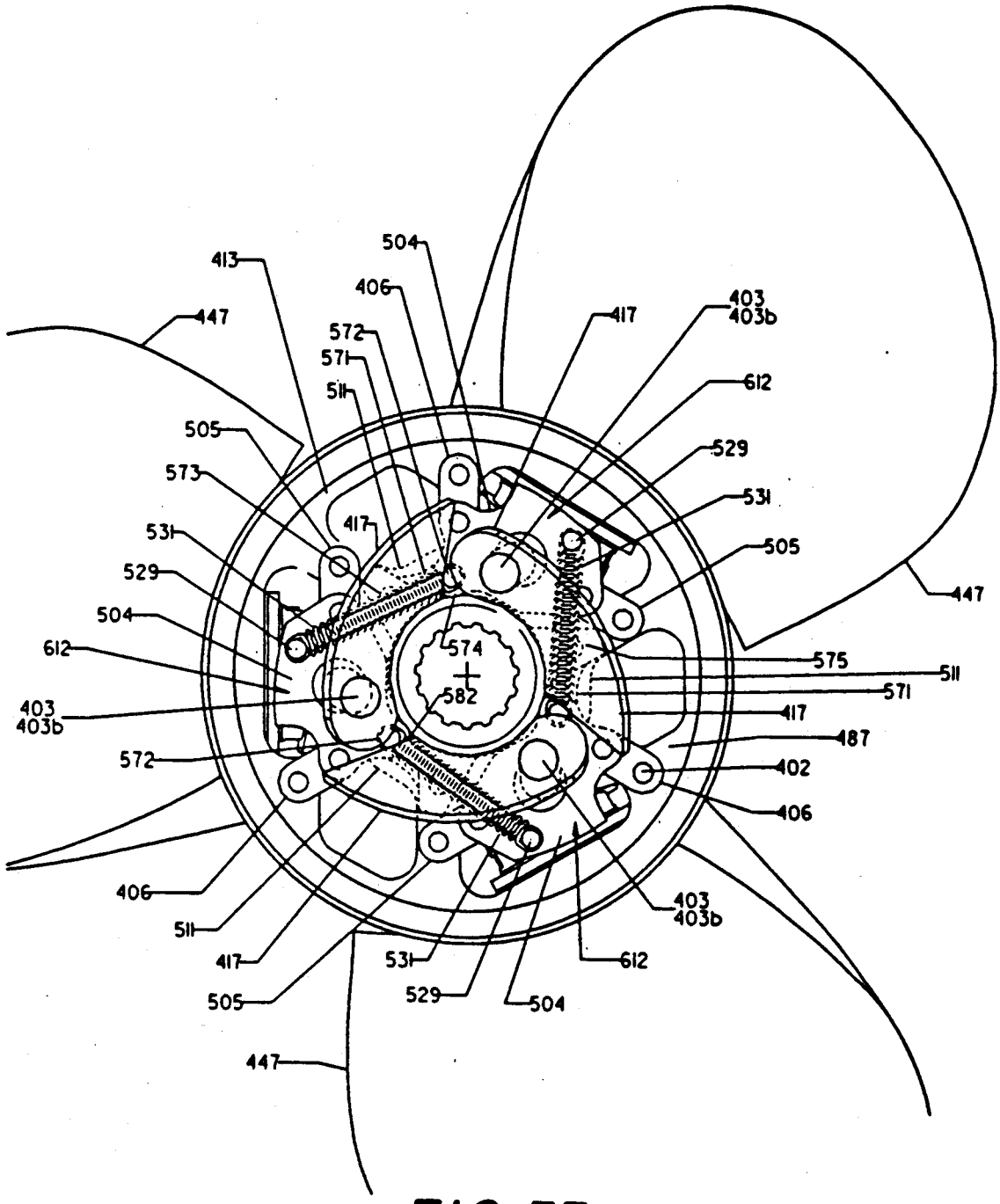
FIG. 33 is a rear view of a second embodiment of the propeller assembly using an inner diameter coordinating ring with the internal mechanism in the low pitch position.
Figure 34:
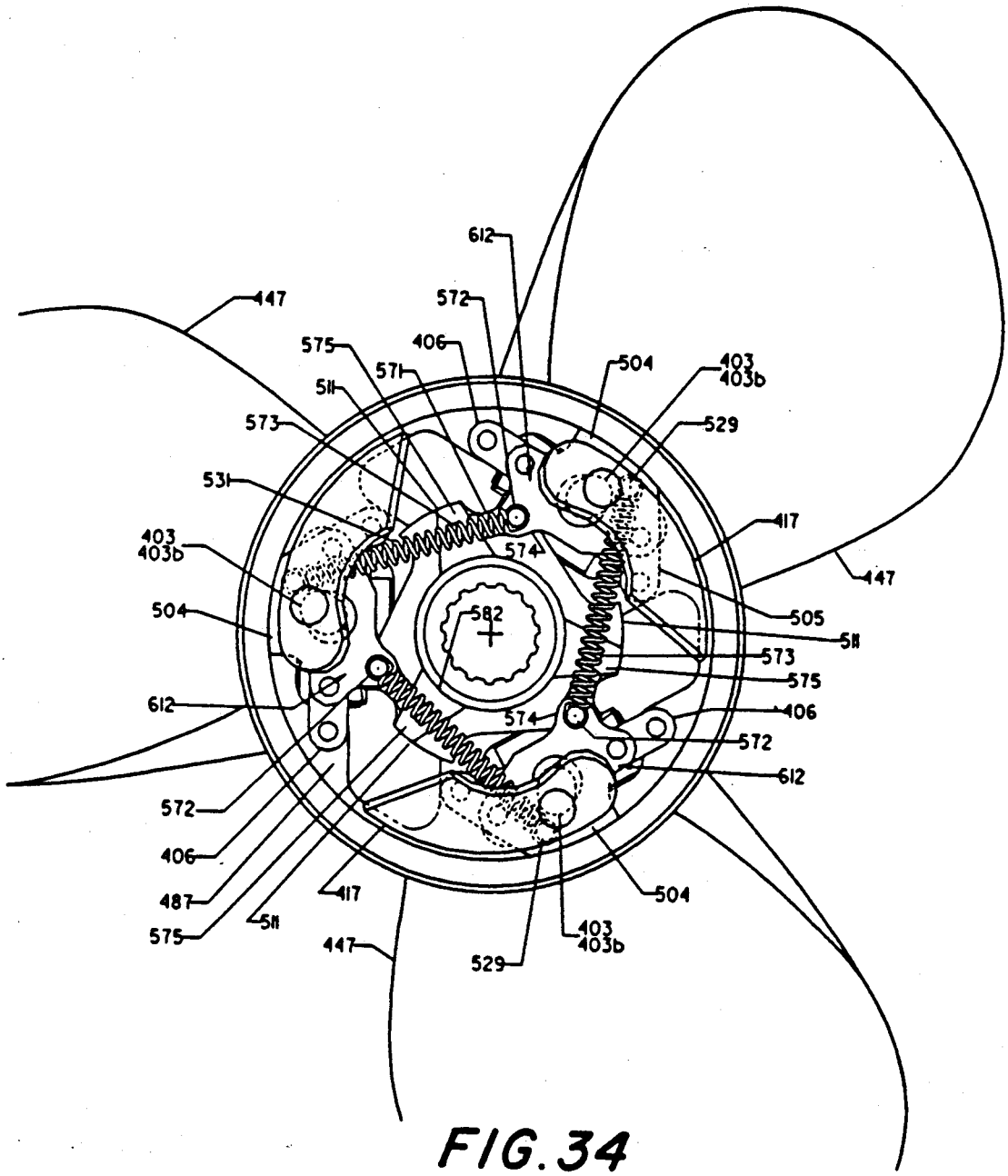
FIG. 34 is a rear view of the propeller assembly of FIG. 33 with the internal mechanism in the high pitch position.
Figure 35:
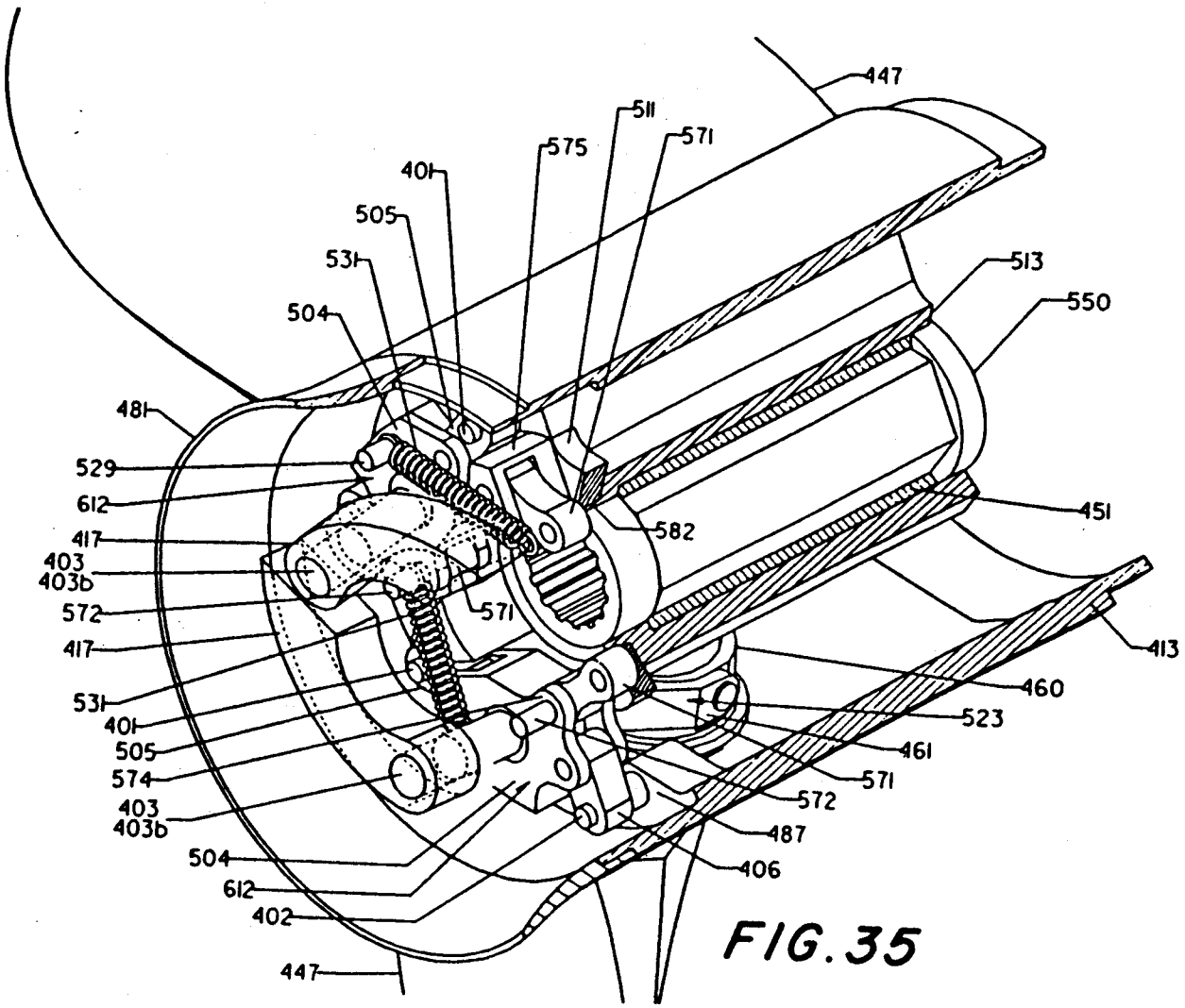
FIG. 35 is a sectional isometric view of the propeller assembly of FIG. 33 with the internal mechanism in the low pitch position.
Figure 36:
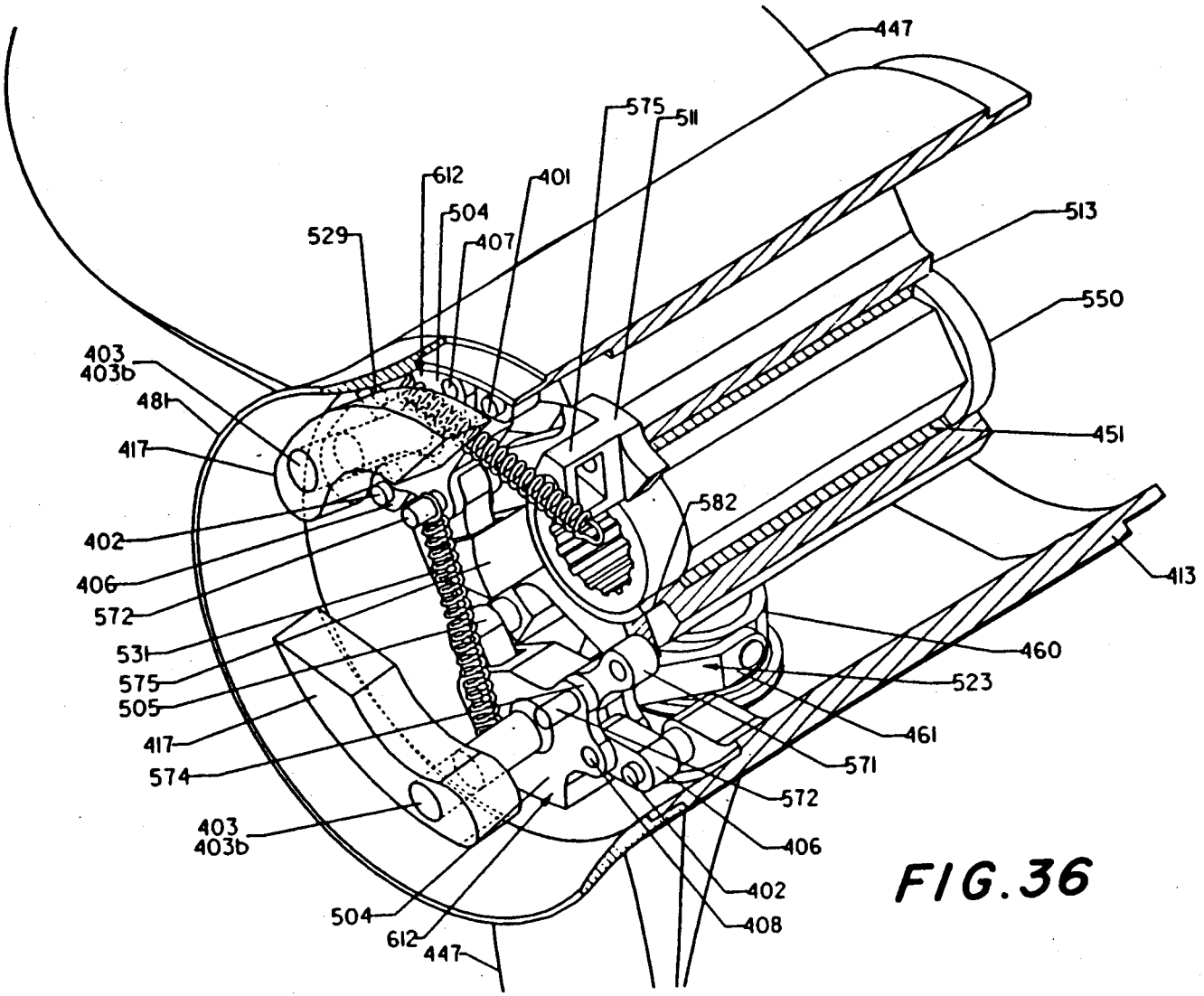
FIG. 36 is a sectional isometric view of the propeller assembly of FIG. 34, in the high pitch position.
Figure 37:
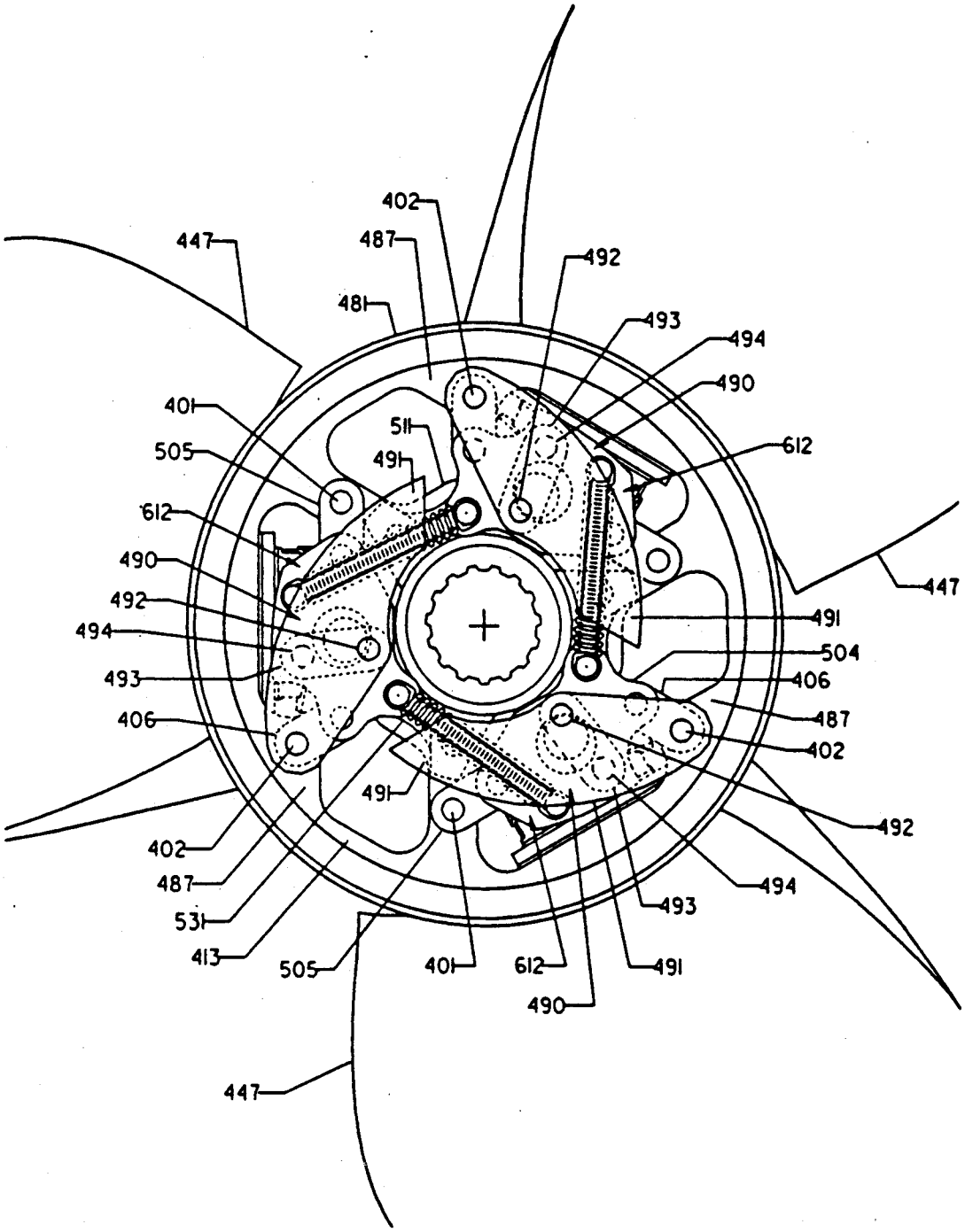
FIG. 37 is a rear view of a third embodiment of the propeller assembly, using an inner diameter coordinating ring and secondary actuating mechanism with the internal mechanism in the low pitch position.
Figure 38:
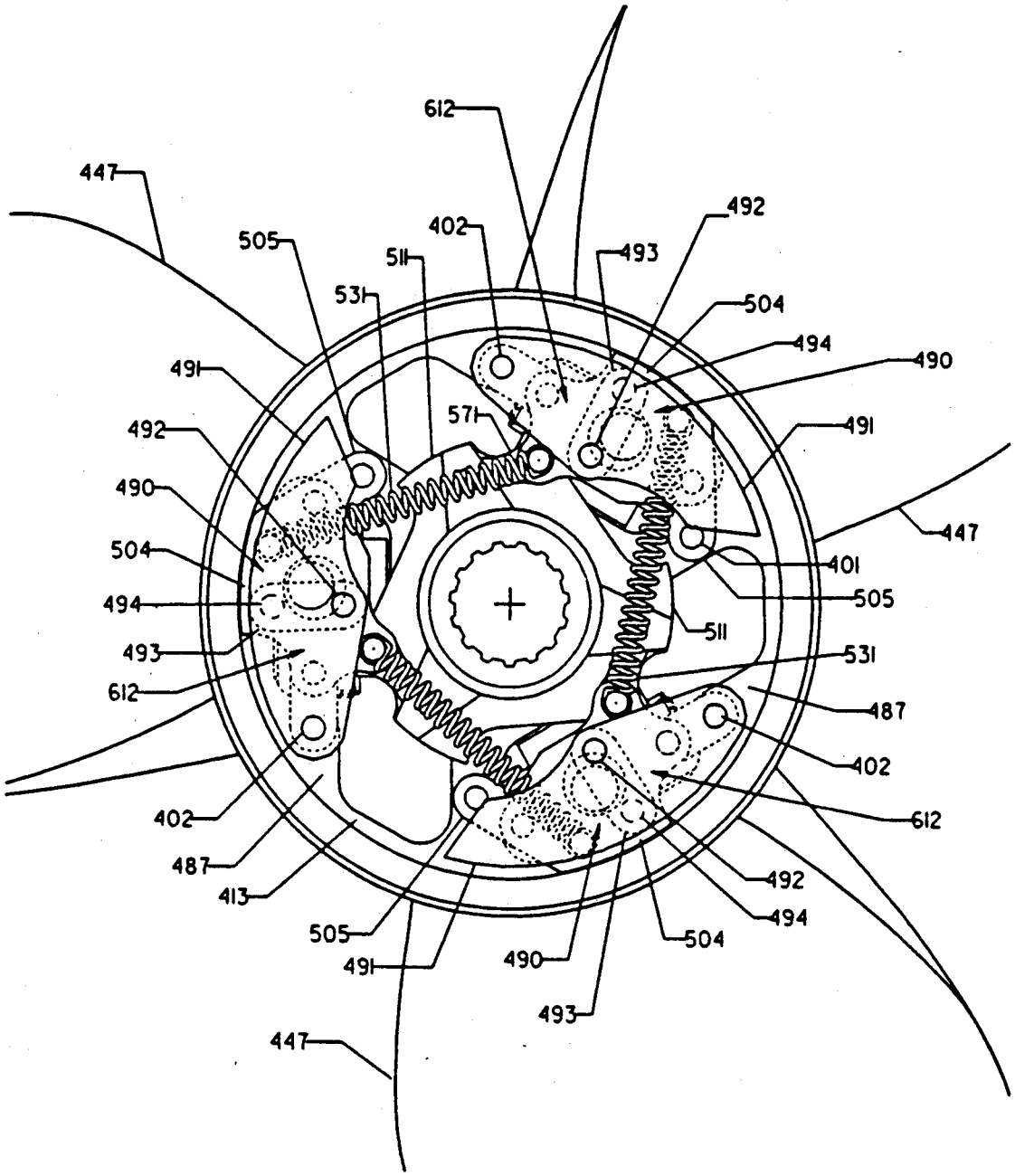
FIG. 38 is a rear view of the propeller assembly of FIG. 37, with the internal mechanism in the high pitch position.
Figure 39:
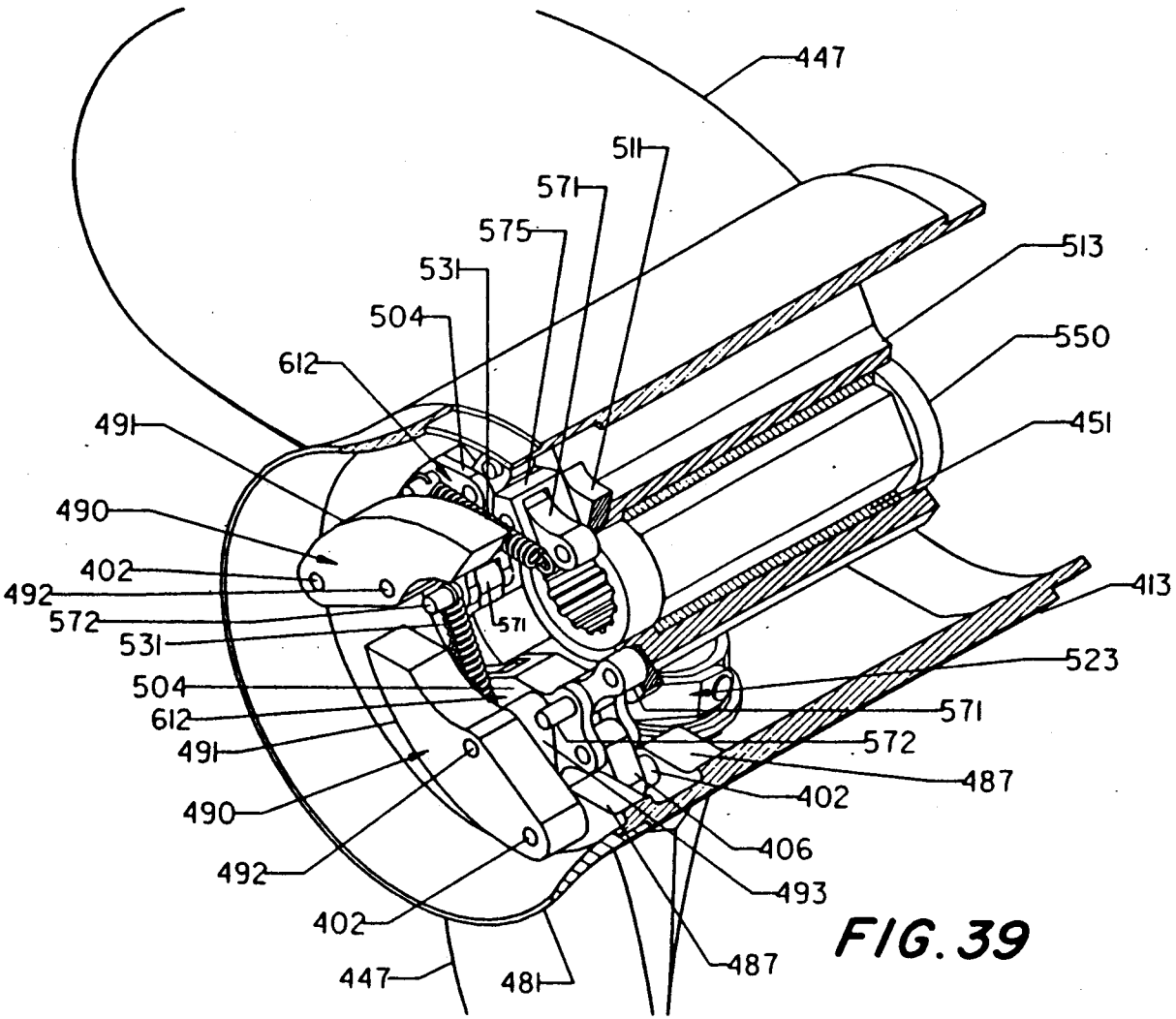
FIG. 39 is a sectional isometric view of the propeller assembly of FIG. 37 with the internal mechanism in the low pitch position.
Figure 40:
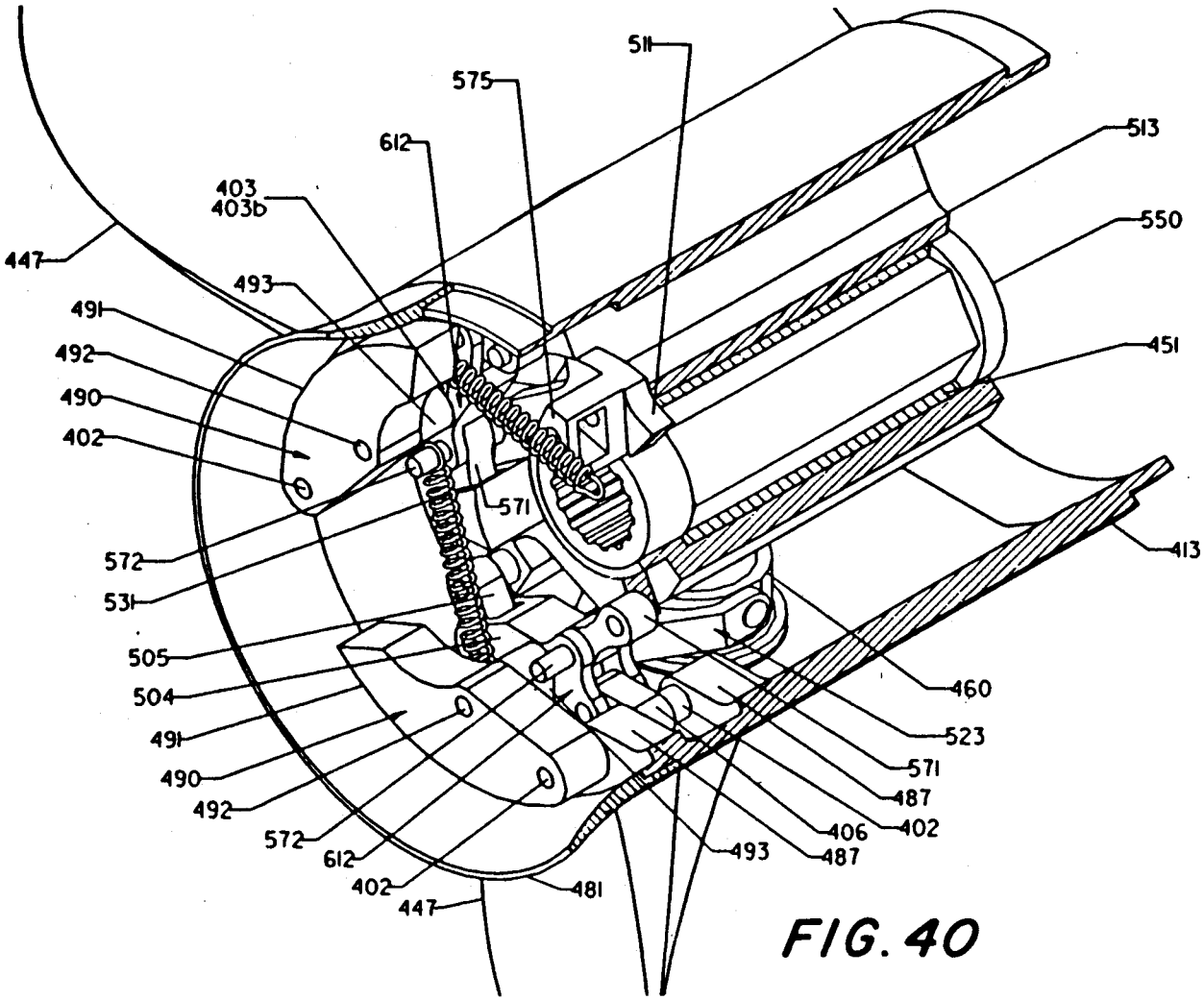
FIG. 40 is a sectional isometric view of the propeller assembly of FIG. 38 with the internal mechanism in the high pitch position.

A fourth embodiment is shown in FIG. 32. In this fourth system, the mechanism is identical to that in FIGS. 37-40, except that the secondary actuating link 491 and the connecting link 493 are eliminated The bell crank link itself is made more massive by utilizing heavier material of construction and/or increasing the thickness of the bell crank link 499, as shown. In this way, the centrifugal inertial force reaction is primarily generated directly by the more massive bell crank link. Although this loses any possible mechanical advantage inherent in the three previously described embodiments, it does further simplify the system by removing unnecessary parts.

The variable pitch propeller of the present invention, is designed, for example, to be secured to a conventional outboard engine or stern drive system; the drive shaft from the outboard engine is slip fitted along the spline 50, 450, and secured between a retaining nut (not shown) on the end of the drive shaft (also not shown), and a thrust washer (also not shown) abutting against the forward end of the spline member 250, 550, such that the entire propeller unit is rotatable with the drive shaft. In this embodiment, an annular layer of elastic material 51, 451 is located between the inner hub 113, 513 and spline coupling 50, 450. This elastic layer 51, 451 provides a means for isolating any vibration and/or shock from the drive system. Passages 480 formed by the hub web provide for engine exhaust to flow through the interior of the hub 413. A flared diffuser ring 481 is attached to the rear of the hub 413 to augment the flow of the exhaust gases through the hub. No other modification to the engine or drive train is necessary.

At rest, the pitch actuating system 512 is in the locked position shown by FIGS. 17, 19, 21, 23 and 25, such that the arm 403 and the bell crank 404 are in the radially inwardmost position. In this locked low-pitch position, the centers of the anchor pin 401, the bell crank pins 407, 408 and the spherical joint 409 can be positioned substantially along a straight line, i.e., "centered", so that any turning moment initially applied to turn the blade 447 towards the high pitch position about its axis, y, or pivot center 10, is resisted by the four-bar linkage locking system 512.

Figure 25:
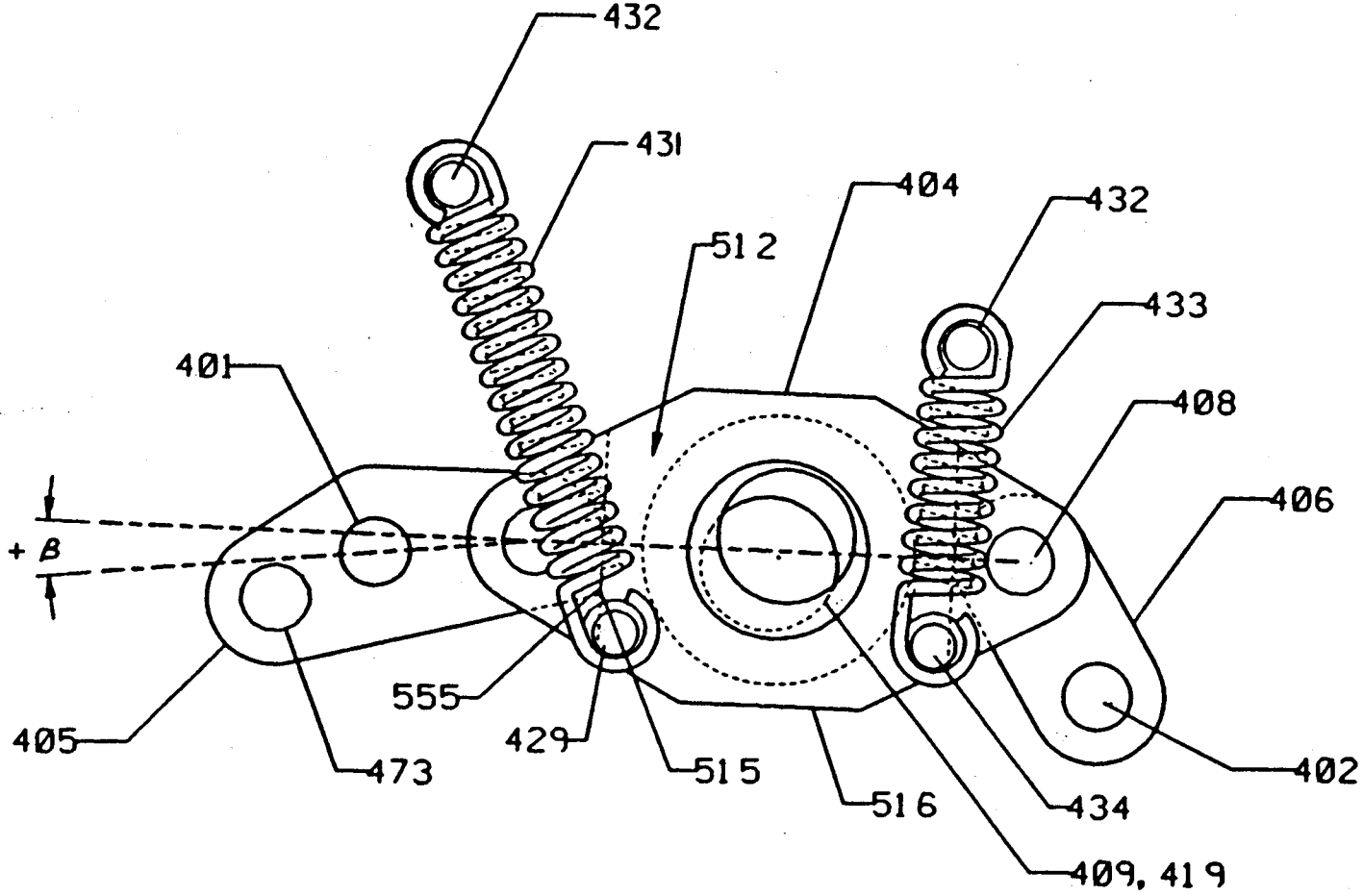
FIG. 25 is an enlarged, partial aft end view showing the locking and positioning mechanism and ball joint geometry for one blade in the locked low pitch position.

In FIG. 25, the locking and positioning system 512 is shown in an over-centered position, where the bell crank 404 is positioned so that the spherical joint 419 and the pin 407 are radially inward such that the line defined by the center of pins 407, 408 and the ball joint 419, form an angle +B with the centered line. In this overcentered position, the turning moment tends to increase the locking force. For example in the first embodiment of FIGS. 2-10, in the low-pitch position, the anchor pin 1, the bell crank pins 7, 8 and the blade arm pin 9 are positioned substantially along a straight line. In this position, any turning moment applied against the blade arm 3 to turn the blade 47 about its pivot center 10 will be resisted by a force transmitted from the arm 3 through the blade arm pin 9, bell crank 4 and the end link 5 to the anchor pin 1. The force acting through the anchor pin 1, which would otherwise tend to rotate the coordinating ring 11, is opposed by a sideward force against the slide bearing 12, secured to the propeller hub 13 and slidably inserted into the slot through the coordinating ring 11 defined by a surface 111. This locking linkage thus prevents premature rotation of the blades 47. Thus is feedback provided to the locking means.

The links of the locking mechanism 512 are initially prevented from rotating outwardly by the biasing spring force from springs 431 and 433 and, as the propeller starts to rotate, the inertial centrifugal force generated by the blade 447. The locking force is also initially increased by the component of the net hydrodynamic load force, transmitted from the blade 447 through the arm 403, to the bell crank 404.

As the rotational speed of the propeller increases, the effect of the hydrodynamics load to increase the locking force at first also increases. Acting against the hydrodynamic locking force component, blade inertial reaction force, and spring forces, as the propeller accelerates, is the inertial, or centrifugal, reaction force resulting from the rotation of the mass of the bell-crank linkages, the blade arm and any counterweights. This locking linkage 512 thus prevents premature rotation of the blades 447 out of the low pitch position, until such time as the inertial reaction force from the actuating system overcomes the spring force and the feedback effect of the net hydrodynamic load forces acting through the arm 403.

This feedback effect alters the timing for releasing the locking mechanism 512, depending upon the manner in which the boat is driven. For example, under the high blade hydrodynamic loads resulting from rapid boat acceleration conditions, the resultant hydrodynamic force on each blade 447 is high and the center of pressure is positioned forward, near the blade leading edge; this results in a high hydrodynamic turning moment about the blade pivot axis, acting to turn the blade toward higher pitch. This turning moment is countered by a force reaction at the spherical joint 409 which is also the pivot center of the bell crank locking mechanism, increasing the locking force. The greater the hydrodynamic turning moment, the greater the overcenter locking force. Since the lock release force, as described above, is derived from centrifugal forces generated by the mass of the locking and release mechanisms, (plus the counterweight 417 or the massive secondary link 491) which remains constant for a given system, a higher propeller rotational speed is required to overcome a higher hydrodynamic locking force component. This design arrangement provides the desirable effect of requiring a higher propeller rpm before shifting the blade position from low to high pitch during high acceleration conditions than is required during low acceleration conditions.

Conversely, the locking mechanism, when positioned in the high pitch position, provides a locking force feedback for boat deceleration conditions, to prevent premature return to the low pitch position.

Figure 26:
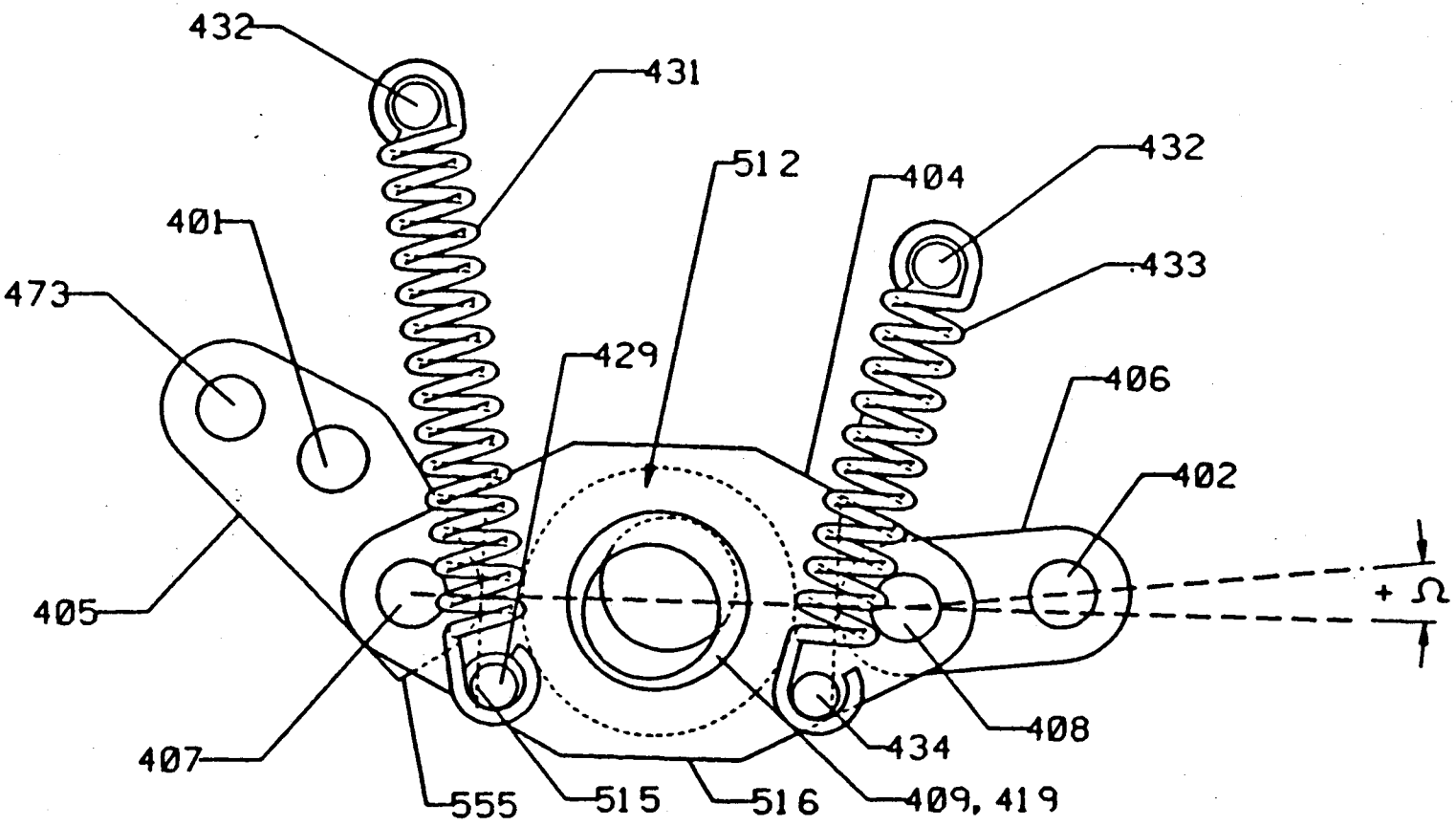
FIG. 26 is an enlarged, partial aft end view showing the locking and positioning mechanism and ball joint geometry for one blade in the locked high pitch position.
Figure 28:
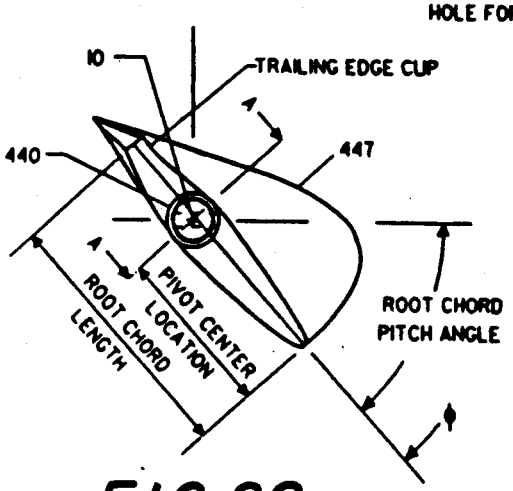
FIG. 28 is an end view of a single cupped propeller blade.
Figure 30:
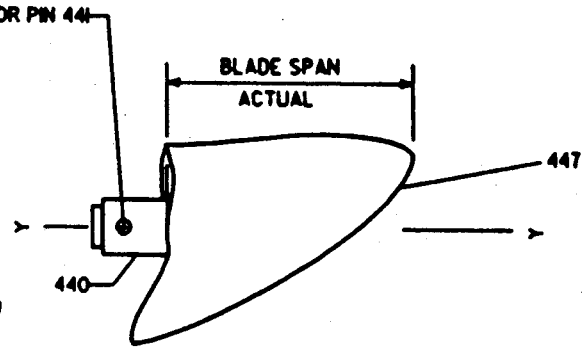
FIG. 30 is a side view of the propeller blade of FIG. 28.
Figure 29:
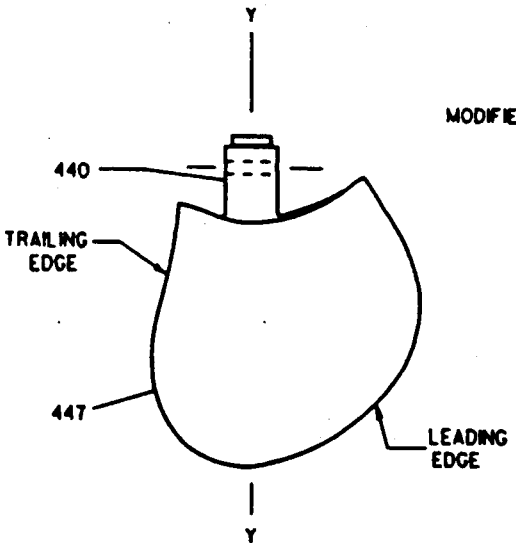
FIG. 29 is a front view of the propeller blade of FIG. 28.

The magnitude of the locking force feedback provided by the hydrodynamic turning moment can be regulated by varying the magnitude of the overcenter angle (B) of the locking mechanism 512, by limiting the maximum rotation of the links. In the locked low pitch position, as shown in FIGS. 25 and 26, the end surface 555 on the end link 405 is juxtaposed in contact with the end surface 515 on the bell crank 404, thus stopping any further radially inward movement of the pivot pin 407. The extent of such over-center movement can thus be varied by changing the shape and/or size at the juxtaposed ends, in an obvious manner. In the high pitch position, the mechanism is locked into the overcenter position when, as shown in FIG. 28, the side planar stop surface 516 on the bell crank 404 abuts against the flattened stop surface portion 506 of the inside surface of the coordinating ring 411. Any other stop means can be used.

The overcenter angle (B) for the locked low pitch position, is defined by the angle between a line connecting the centers of the anchor pin 401 and the link pivot 407 and a line connecting the center of the spherical joint 409 and the link pivot 407. The overcenter angle ($\Omega$) for the locked high pitch position is defined by the angle between a line connecting the centers of the anchor pin 402 and link pivot 408, and a line connecting the centers of the spherical joint 409 and the link pivot 408. The overcenter angle (B) for the low pitch position for these later embodiments of FIGS. 16–40, is preferably in the range of from about 10 to about 25 degrees, and most preferably from about 13 to about 17 degrees. The value of the overcenter angle for the high pitch locked position ($\Omega$); for the embodiments of FIGS. 16–40 is preferably no more than about 5 degrees.

It is important to the operation of the discrete two position self actuating propeller described herein that the blades be locked in the low pitch positions, with sufficient overcenter angle (+B) to provide means to allow the hydrodynamic loading on the propeller blades to "feedback" into the locking mechanism 512. Although it is also preferred to provide an overcenter angle ($+\Omega$) for the locked high pitch position to eliminate any tendency to "downshift" prematurely, it is not always necessary that an overcenter angle be provided in the high pitch position. Also, depending upon the amount of mass of the actuating mechanism, sufficient inertial force may be generated to effectively hold the mechanism in the high position such that the angle ($\Omega$) need not go overcenter and can even be negative or "undercenter" ($\Omega$). If the locking and positioning mechanism 512 is provided with stops that position the link angle ($\Omega$)in the undercenter position, then the locking and positioning mechanism 512 is effectively only locking the blades when in the low pitch positions, and the blades and mechanism are effectively "held" in the high pitch position by the actuating mechanism mass when in the high pitch limit position.

In operation, when the propeller begins to rotate from a rest position, the blades 447 are in a low pitch position, e.g. at a pitch of 15 inches, for a boat weighing 3000 lbs., 23 ft long and having a single stern drive engine generating its maximum power of 260 horsepower at 4600 rpm with the propeller rotating at approximately ⅔ engine speed.

As the engine speed increases, and the rotational speed of the propeller assembly increases, centrifugal forces acting on the locking mechanism 512 and the actuating mechanism 523 also increase, causing the arm 403 to rotate radially outwardly about pin 441, towards the outer hub 413. The actuating mechanism 523 is biased towards the radially inward position shown in FIGS. 17, 19, 21, 23 and 25 by the spring force of the springs 431 and 433 acting against the bell crank 404, which, in turn is connected to arm 403. As the centrifugal force exerted by the net actuating mass (i.e. the combined mass of the yoke 461, the arm 403, the ball 419, the bell crank 404 and the pivot pins 407, 408 and the counterweights 417) increases, it acts against the biasing force of the spring 431, until the centrifugal force component acting along, but opposite to, the spring 431, exceeds in absolute value the spring biasing force plus the locking mechanism overcenter force component (i.e. the reaction to the hydrodynamic loading on the blade 447), and friction; the arm 403 and bell crank 404 are then moved radially outwardly, thereby causing pivoting of the end links 405, 406, until the pitch locking mechanism 512 is in the high pitch over-center locked position, shown in FIGS. 18, 20, 22, 24, and 26, and further rotation is prevented by the juxtaposed contact of the stop surfaces 506, 516.

Each of the pitch change release and actuating mechanisms 523 (and 490) is so designed as to increase its mechanical advantage as the actuating arm 403 swings radially outwardly, i.e., towards the hub case 413, thereby increasing the radius of the mass, and thus of the centrifugal force, in opposition to the bias force of the spring 431. Thus, the force generated by the net actuating mass as it moves outward continues to be greater than the spring rate of the spring 431, thereby promoting a continuous and smooth outward movement of the bell crank 404 to its high pitch position. Further promoting this smooth outward movement is the reduction in friction, i.e., from static friction to sliding friction, and the elimination of the overcenter force component upon the release of the locking and positioning mechanism 512, i.e., as soon as the overcenter angle is reduced to zero.

The mechanical geometry of the actuating mechanism 523 (and 490) is such that the rotational speed of the propeller is reduced to a substantially lower rpm before the blades return to the low pitch position, than is required to cause the mechanism to move to the high pitch position from the low pitch position. This tends to reduce premature release of the locking mechanism when down shifting, and improves the smoothness and desired timing of the pitch change movement.

As the propeller rotational speed increases, the center of pressure of the resultant hydrodynamic force normally moves aft (for the NACA propeller used herein), or toward the blade trailing edge 547, thereby reducing the feedback locking load.

The movement of all of the blade arms 403 is coordinated through the connecting links 471 pivotally attached between the links 405 and the coordinating ring 411, such that all three propeller blades 447, in this embodiment, rotate substantially simultaneously and equally.

When locked into the high pitch position, any turning moment tending to move the blades 447 back towards the low pitch position is resisted by the force translated through the blade arm 403, to the spherical joint 409, the bell crank 404, the pivot pin 408, and the end link 406 to the anchor pin 402.

Upon deceleration of the boat and engine, and reduction of the rotational speed of the propeller, at the time that the sum of the centrifugal force component generated by the net actuating mass of mechanisms 523 and 512 (including the counterweight 417), plus friction, is exceeded by the spring force component exerted by the return spring 431, the bell crank 404 is caused to move radially inward, out of the overcenter position. This unlocks the bell crank mechanisms 512, permitting the blade arms 403 to rotate together with the blades 447 towards the low pitch position, in response to the turning moment generated by hydrodynamic loading on the blades. Again, the rotation of the coordinating ring 411 acting along with the blade arms 403, via the links 471, 405, 404, 406 cause the blades 447 to all rotate substantially simultaneously and equally.

It is noted that the structural drawings are drawn to scale, within each drawing. In the illustrated example, shown in FIGS. 16 thru 26, the propeller diameter is 13.6 inches, and the hub diameter is 4.6 inches. The weight of each blade 447, including the shank 440 is about 12 oz., the blade plan form area is 26 inches, and the length of the blade actuator arm 403 is 1.2 inches as measured axially from the pivot center 10 to the center of the ball 419. The counterweight 417 weighs 7.4 oz. and its center of gravity is located 0.93 inches radially from the hub centerline when in the low pitch position. The biasing spring 431 has a spring constant of 114 lbs./in. and is extended to provide an initial preload of 36 lbs. in the low pitch position. The biasing spring 433 has a spring constant of 28 lbs./in. and is extended to provide an initial preload of 9 lbs. in the low pitch position.

When the locking mechanism overcenter angle is about 20 degrees, the difference in the upshifting point propeller speed between light engine load and heavy engine load is about 25 percent, e.g., from about 1500 rpm to about 1800 rpm.

The angular displacement of the blades from low to high pitch position is approximately 8 degrees. When positioned in the low pitch position, the propeller performance is comparable to that provided by a fixed 15-inch pitch propeller, and when positioned in the high pitch position, the propeller performance is comparable to that provided by a fixed 21-inch pitch propeller, for propellers having equivalent hydrofoil geometry.

These drawings show preferred embodiments comprising a locking and positioning mechanism and releasing and actuating mechanism associated with each blade, e.g., three blades 447, three locking and positioning mechanisms 512, and three actuating or lock releasing, mechanisms 523. However, the numbers of blades, locking linkages and actuating mechanism, need not be equal to three, or equal to each other.

The propeller is preferably constructed of aluminum and/or other corrosion-resistant materials, such as bronze, stainless steel or other corrosion-resistant metal, or impact-resistant non-metals, such as polycarbonates, acetals or reinforced polymers.

We claim:

1. A variable pitch marine propeller comprising a hub case; a plurality of blades extending radially outwardly from the hub case, each blade being mounted to the hub for pivotal movement about a blade axis between two extreme angular pitch positions, and drive securing means designed to secure the propeller to a rotating drive shaft on a boat, such that the propeller rotates with the drive shaft, characterized by: the propeller further comprising position locking means for maintaining the blades in a locked, lower pitch, angular position while the propeller is being rotated by a drive shaft; release means, operably engaging the locking means for releasing the position locking means in response to the propeller being rotated at a minimum threshold rotational velocity; and pitch shifting means, responsive to the rotational speed of the propeller, for causing the blades to pivot from one extreme angular pitch position to the other angular position, upon release of the locking means.

2. The variable pitch marine propeller of claim 1, further comprising position locking means, release means and pitch shifting means, secured to each of the plurality of blades, and pitch shifting coordinating means operably connected between all of the position locking means for causing all of the blades to pivot from one angular position to the other angular position substantially simultaneously upon the release of any one of the locking means.

3. The variable pitch marine propeller of claim 1, wherein rotation of the propeller generates a resultant turning moment from the blade, the turning moment resulting from the sum of a hydrodynamic force and an inertial centrifugal force reaction; and the propeller further comprising a feedback force transmitting and blade actuating means, operably connected between a blade and the locking means, for transmitting the resultant turning moment from the blade to the locking means; the feedback force transmitting means and the locking means being so interconnected that the resultant turning moment increases the locking force effectiveness of the locking means when in the low pitch position.

4. The variable pitch marine propeller of claim 3, wherein the feedback force transmitting means is integral with the release means and comprises a biaxial force transmitting member pivotally secured between a blade and the locking means for transmitting about one axis a resultant turning moment from a blade to the locking means, and for transmitting about a second axis a centrifugal releasing force to release the locking means, the transmitting member being so designed and juxtaposed that any resultant turning moment generated by the blade acts to increase the locking effectiveness of the locking means.

5. The variable pitch marine propeller of claim 3, wherein the release means comprises a slider member slidably held within the hub, and wherein the locking means and the slider member form a four-bar linkage, the locking means comprises two outer rocker links and a central coupler link; each of the two rocker links, at one location, being pivotally connected to the coupler link, and at a second location of each rocker link being pivotally secured to the slider; the four-bar linkage being so designed that translational movement of the slider requires pivoting of the rocker links, and release of the locking means; and further wherein the feedback force transmitting means comprises a blade actuating arm secured at one location to the blade and extending within the hub transversely to the blade axis, the blade actuating arm being pivotally connected to a central portion of the central coupler link.

6. The variable pitch marine propeller of claim 5, wherein the locking means comprises a four bar linkage mechanism, pivotally connected to the hub case at one end and wherein the feedback force transmitting member comprises an arm pinned at one axial location to the blade so as to be independently rotatable about an axis transverse to the blade axis and to be pivotable with the blade about the blade axis, and extending generally axially within the hub case, transversely to the blade axis; the actuating arm being axially and spherically slidably secured at another axial location to one link of the locking means.

7. The variable pitch marine propeller of claim 6, comprising a limited bias force means acting on the locking means in opposition to the centrifugal releasing force up to a maximum magnitude, the releasing force being capable of exceeding the maximum countervailing force at a sufficient rotational speed, such that the release means is activated when the rotational speed of the propeller exceeds such sufficient value.

8. The variable pitch marine propeller of claim 7, wherein the bias force means comprises a biasing spring member.

9. The variable pitch marine propeller of claim 6, comprising auxiliary inertial mass means operably connected to a link of the locking means, such that upon rotation of the propeller an increased centrifugal inertial force reaction is imparted to the locking means to tend to move the locking means out of the locked low pitch position.

10. The variable pitch marine propeller of claim 6, further comprising secondary release means, the secondary release means including a separate inertial mass member pivotally connected between the hub and the locking means, and so juxtaposed therewith that the centrifugal inertial force reaction generated thereby upon rotation of the hub is greater in a radially outward direction when the locking means is in the high pitch position than when the locking means is in the low pitch position.

11. The variable pitch marine propeller of claim 1, wherein the locking means comprises a four bar linkage including two rocker links, a connect link and a coupler link, one location on each rocker link being pivotally secured to the coupler link, a second location on each rocker link being pivotally secured to the hub case, and a third location on one of the rocker links being pivotally secured to the connect link, which is in turn pivotally connected to the coordinating means; the coupler link being also pivotally and slidably secured to the transmitting member and so juxtaposed therewith that pivoting of the transmitting member radially within the hub causes radial translational movement of the coupler link and pivoting of the rocker links, and movement of the coordinating means.

12. The variable pitch marine propeller of claim 1, wherein the locking means comprises a four bar linkage including two rocker links, a connect link and a coupler link, one location on each rocker link being pivotally secured to the coupler link, a second location on each rocker link being pivotally secured to the hub case, and a third location on the coupler link being pivotally secured to the connect link, which is in turn pivotally connected to the coordinating means; the coupler link being also pivotally and slidably secured to the transmitting member and so juxtaposed therewith that pivoting of the transmitting member radially within the hub causes radial translational and pivoting movement of the coupler link and pivoting of the rocker links, and movement of the coordinating means.

13. The variable pitch marine propeller of claim 1, wherein the pitch shifting means comprises blade counter-weights, a counter-weight being secured to each of the blades such that upon rotation of the propeller a centrifugal force is imparted to the blades to tend to pivot the blades from one pitch position to the other higher pitch position.

14. A variable pitch propeller of claim 13 wherein the counter-weight is secured about the axis of the blade and is so designed that its center of gravity is positioned at one of the following locations: i) aft of the blade pivot center relative to the drive shaft axis and offset toward the direction of propeller rotation relative to the pivot axis; and ii) forward of the blade pivot axis relative to the drive shaft axis and offset opposite to the direction of propeller rotation relative to the pivot axis.

15. The variable pitch marine propeller of claim 5, wherein the release means comprises an actuating mass and a release member located within the hub case, the actuating mass being pivotally connected to the release member and to the hub case, such that rotation of the marine propeller causes the actuating mass to generate a centrifugal inertial reaction force and thus to pivot radially outwardly and to move the release member relative to the hub case; the release member being slidably positioned within the hub and operably connected to each locking means, such that sliding movement of the release member in response to movement of the actuating mass releases and relocks the locking means and coordinates the simultaneous pivoting of the blades.

16. The variable pitch propeller of claim 15, wherein the release means forms a four-bar toggle-slider linkage mechanism comprising two rocker links, the actuating mass, and the release member, acting as a slider link, the first rocker link being pivotally pinned to the hub and to the actuating mass link, and the actuating mass link being pivotally pinned to the second rocker link which is in turn pinned to the ring, the links being so juxtaposed within the hub that rotation of the propeller generates a centrifugal force acting on the linkage mechanism tending to move the release member axially along the propeller shaft axis towards the second locked position.

17. The variable pitch marine propeller of claim 16, further comprising limited countervailing force means acting in opposition to the releasing force up to a maximum magnitude, the releasing force being capable of exceeding the maximum countervailing force at a sufficient rotational speed, such that the release means is activated when the rotational speed of the propeller reaches such sufficient value.

18. The variable pitch marine propeller of claim 17 wherein the counter-vailing force means is a biasing spring acting upon the release means in a direction opposite to that of the centrifugal force member.

19. The variable pitch marine propeller of claim 9, wherein the auxiliary inertial mass means is secured to the end of the transmitting member distal from the blade.

20. A variable pitch marine propeller comprising a hub case; drive securing means designed to secure the propeller to a rotating drive shaft on a boat such that the entire propeller rotates with the drive shaft; a plurality of blades extending transversely outwardly from the hub case and rotatably secured to the hub case about a blade axis transverse to the axis of the drive shaft, for pivotal movement about the blade axis between two extreme angular pitch positions; each blade comprising a hydrodynamic surface; pitch shifting means operably connected to a blade and designed to cause the blade to pivot from one angular position to the other angular position in response to a change in the speed of rotation of the propeller; the hydrodynamic surface and the shaft pivotal axis being so juxtaposed that the resultant hydrodynamic force vector generated upon rotation of the propeller acts along a line intersecting the hydrodynamic surface at a point intermediate the axis of rotation of each blade and the leading edge of the blade and extending transverse to the blade axis of rotation; restraining means, operably connected to the pitch shifting means to restrain operation thereof and thus restrain pivoting of the blades; transmission means operably connected between the blade and the restraining means to transmit to the restraining means the resultant torque created by the hydrodynamic force vector and to generate a force acting against rotation of the blade towards the high pitch position and proportional to the resultant hydrodynamic torque.

21. The variable pitch marine propeller of claim 20 wherein the restraining means comprises affirmative locking means, the blade further comprises a blade shaft extending axially between the hydrodynamic surface and the hub case, the blade shaft being pivotally secured to the hub case, and the transmission means comprises a member extending generally transverse to the blade shaft.

* * * * *